US006998934B2

(12) United States Patent
Nakano

(10) Patent No.: US 6,998,934 B2
(45) Date of Patent: Feb. 14, 2006

(54) HIGH FREQUENCY SWITCH AND ELECTRONIC DEVICE INCLUDING THE SAME

(75) Inventor: Hiroyuki Nakano, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 27 days.

(21) Appl. No.: 10/897,203

(22) Filed: Jul. 23, 2004

(65) Prior Publication Data

US 2005/0017820 A1 Jan. 27, 2005

(30) Foreign Application Priority Data

Jul. 24, 2003 (JP) ..... 2003-201282
May 27, 2004 (JP) ..... 2004-157925

(51) Int. Cl.
*H01P 1/10* (2006.01)

(52) U.S. Cl. ..... 333/103; 333/262

(58) Field of Classification Search ..... 333/101, 333/103, 104, 262, 204; 257/275
See application file for complete search history.

(56) References Cited

U.S. PATENT DOCUMENTS

| | | | | |
|---|---|---|---|---|
| 6,259,332 | B1 * | 7/2001 | Hosoya | 331/96 |
| 6,455,880 | B1 * | 9/2002 | Ono et al. | 257/275 |
| 6,876,280 | B1 * | 4/2005 | Nakano | 333/262 |

FOREIGN PATENT DOCUMENTS

| | | |
|---|---|---|
| GB | 2 020 899 | 11/1979 |
| JP | 63-161701 | 7/1988 |
| JP | 03-089701 | 4/1991 |
| JP | 06-232601 | 8/1994 |
| JP | 10-041404 | 2/1998 |
| JP | 2000-294568 | 10/2000 |
| JP | 2000-332502 | 11/2000 |
| JP | 2002-033602 | 1/2002 |

* cited by examiner

*Primary Examiner*—Dean Takaoka
(74) *Attorney, Agent, or Firm*—Keating & Bennett, LLP

(57) ABSTRACT

A high frequency switch includes a main line electrode arranged on a substrate so as to extend between two terminals, a short stub line electrode on the substrate of which one end is connected to a one-side edge of the main line electrode, and the other end is grounded, an open stub line electrode on the substrate of which one end is connected to the other-side edge of the main line which is opposed to the one-side edge, and the other terminal is opened, ground electrodes arranged on the substrate adjacent to the short stub line electrode and the open stub line electrode in the width direction thereof, a semiconductor activation layer disposed in a portion of the substrate between the side edge at least on the one-end side of the open stub line electrode and the ground electrode so as to extend under the open stub line electrode and under the ground electrode, and a gate electrode disposed on the semiconductor activation layer between the open stub line electrode and the ground electrode so as to extend along the longitudinal direction of the open stub line electrode, whereby an FET structure is provided.

18 Claims, 34 Drawing Sheets

ENLARGED A-A LINE CROSS-SECTIONAL VIEW

ENLARGED A-A LINE CROSS-SECTIONAL VIEW

HIGH FREQUENCY SWITCH AND ELECTRONIC DEVICE INCLUDING THE SAME

BACKGROUND OF THE INVENTION

1. Field of the Invention

The present invention relates to a high frequency switch and an electronic device including the same, and more particularly to a high frequency switch for switching a signal especially in an extremely high frequency band and an electronic device including the same.

2. Description of the Related Art

Generally, switches containing PIN diodes are used for the change-over of signals in an extremely high frequency band. Moreover, switches using an FET are used for signals in a relatively low frequency region in the extremely high frequency band. Especially, there are used switches utilizing lines through which high frequency signals are transmitted, as the drains and the sources of the FET. Such switches are specifically disclosed in Japanese Unexamined Patent Application Publication Nos. 6-232601 (Patent Document 1), 10-41404 (Patent Document 2), 2000-294568 (Patent Document 3), and 2000-332502 (Patent Document 4).

As disclosed in Patent Document 1, a signal line is separated by plural slits which cross the signal line in the width direction to form plural drain electrodes. Source electrodes and gate electrodes (lines) are formed, which extend in the width direction of the signal line similarly to the slits. Thus, the high frequency switch uses a part of the signal line as an FET (e.g., see FIG. 13 of Patent Document 1). The respective drain electrodes are connected to each other with metallic wirings. An inductance element is connected between the drain and the source of the FET, which parallel-resonates with the off-capacitor of the FET at a signal frequency.

Referring to Patent Document 1, the signal line itself, including the part thereof where the FET is formed, is always in the DC conduction state. When the FET is on, the impedance of the circuit connected between the signal line and the ground becomes small, causing substantially the short-circuited state. As a result, a part of the signal line is substantially grounded, so that a high frequency signal is reflected, and thus, the conduction is blocked. On the other hand, when the FET is off, the impedance at the frequency of the high frequency signal of the circuit connected between the signal line and the ground becomes infinite, due to the parallel resonance of the off-capacitor of the FET and the inductance element. This means that equivalently, nothing is connected to the signal line at the frequency of the high frequency signal. Thus, the high frequency signal is transmitted and the switching operation is carried out.

Patent Document 2 discloses a high frequency switch in which a ground electrode (which functions as a source electrode) is formed adjacently to a part of a signal line (which functions as a drain electrode) so as to extend in the longitudinal directional of the signal line, and a gate electrode is formed in the gap between the signal line and the gate electrode so as to extend in the longitudinal direction of the signal line (e.g., see FIG. 6 in Patent Document 1).

In the high frequency switch disclosed in Patent Document 2, when the FET is off, the part of the signal line which has a function as a drain simply operates as a signal line. Thus, a high frequency signal is transmitted through the signal line. On the other hand, when the FET is on, the part of the signal which has a function as a drain is connected to the ground electrode. Hence, the part of the signal line is substantially grounded, so that the high frequency signal is reflected, and the conduction is blocked.

Patent Document 3 discloses a configuration which is similar to the PET configuration of Patent Document 1 (e.g., see FIG. 3 of Patent Document 3, where no inductance element for parallel resonance is provided). In the configuration of Patent Document 3, the drain, the source, and the gate of the FET are formed so as to extend in the line direction of the signal line (see FIG. 1 of Patent Document 3).

The operation of the high frequency switch disclosed in Patent Document 3 is the same as that of the high frequency switch of Patent Document 2 in that when the FET is on, the part of the signal line is substantially grounded, so that the propagation of the high frequency signal is blocked.

As disclosed in Patent Document 4, a one-fourth wavelength stub is connected to the main line of a signal line, the top portion of the stub functions as a drain electrode, and the source electrode is grounded. Thus, the FET is formed (see FIGS. 2 and 6 of Patent Document 4). By turning the FET on-off, the stub is caused to function as a short stub or an open stub.

The operation of the high frequency switch disclosed in Patent Document 4 is the same as that of the high frequency switches of Patent Documents 2 and 3 in that when the FET is off, the stub functions as a one-fourth open stub, so that a part of the signal line is substantially grounded at the frequency of a high frequency signal, whereby the propagation of the high frequency signal is blocked.

Referring to Patent Document 1, the conduction resistance caused when the FET is on is required to be small. For this purpose, it is necessary to increase the splitting number for the signal line so that the number of gate electrodes increases, and the total gate width of the FET becomes large. When the total gate width is increased, inevitably, the off-capacitor of the FET becomes large. Therefore, it is necessary to reduce the inductance of the inductance element for parallel resonance. However, reducing the size of the inductance element while the accuracy of the inductance is kept has a limitation. When the signal frequency becomes higher, the inductance is required to be smaller. Thus, problematically, it is more difficult to use the configuration at a higher signal frequency.

On the other hand, according to Patent Document 2, the high frequency switch utilizes no resonance phenomenon. Thus, the above-described problem in that the use of the high frequency switch becomes difficult at a higher signal frequency does not occur. However, according to the high frequency switch of Patent Document 2, the main line of the signal line through which a high frequency signal flows when the switch is on functions as the drain electrode of FET. At least a part of the drain electrode is formed on a semiconductor activation layer. That is, a part of the main-line is formed on the semiconductor activation layer. The semiconductor activation layer is a conductor having a higher resistance than the drain electrode. Thus, this means that the resistance of the main line becomes large. Accordingly, in the high frequency switch in which the main line functions as the drain electrode of FET as disclosed in Patent Document 1, problematically, the function of the main line as the drain electrode causes the insertion loss of the main line to increase.

The on-resistance per unit length of the FET (per unit gate-width) can be changed by modifying the sectional-configuration of the FET. However, it is difficult to carry out the modification. In the case in which the on-resistance per unit length can not be changed, it is necessary to increase the gate width of the FET to sufficiently ground the main line electrode when the FET is on. Increasing of the gate width of the FET means that the gate electrode is extended in the longitudinal direction of the signal line. Thus, the length of the drain electrode increases. This means that the size of the switch increases in the longitudinal direction of the main line. The drain electrode is composed of the main line electrode through which a high frequency signal flows, the main line electrode being formed on the semiconductor activation layer. Therefore, the insertion loss of the main line electrode as described above will be further increased.

The high frequency switch disclosed in Patent Document 3 has the same basic configuration as that of the high frequency switch of Patent Document 1. Thus, similar problems occur.

Referring to the high frequency switch disclosed in Patent Document 4, the main line through which a high frequency signal flows does not function as a drain electrode. Thus, the problem in that the insertion loss when the switch is on increases does not occur. However, for the purpose of grounding the end of the stub at a satisfactorily low resistance, it is necessary to sufficiently increase the gate width. When the gate width of the FET is increased, the capacitance between the drain and the source, caused when the FET is off, increases. This means that a large capacitance is produced between the top of the open stub and the ground when the FET is off. When the large capacitance is present at the top of the open stub, the resonance frequency of the open stub is reduced. Thus, most probably, it will differ from the resonance frequency of the short stub. Since the resonance frequencies of the open stub line electrode and the short stub line electrode can not be set to be equal to each other, the high frequency switch can not properly function as a switch. These problems are to be solved.

SUMMARY OF THE INVENTION

In order to overcome the problems described above, preferred embodiments of the present invention provide a high frequency switch which can be used even at a high frequency and of which the insertion loss occurring when the switch is on is small, and moreover, the signal cutoff characteristic obtained when the switch is off is high, and also provide an electronic device including such a novel high frequency switch that solves the above-described problems.

According to a preferred embodiment of the present invention, a high frequency switch includes a main line electrode arranged on a substrate so as to extend between two terminals, a short stub line electrode on the substrate of which one end is connected to a one-side edge of the main line electrode, and the other end is grounded, an open stub line electrode on the substrate of which one end is connected to the other-side edge of the main line which is opposed to the one-side edge, and the other terminal is opened, ground electrodes disposed on the substrate adjacent to the short stub line electrode and the open stub line electrode in the width direction thereof; a semiconductor activation layer provided in a portion of the substrate between the side edge at least on the one-end side of the open stub line electrode and the ground electrode so as to be extended under the open stub line electrode and under the ground electrode, and a gate electrode arranged on the semiconductor activation layer between the open stub line electrode and the ground electrode so as to extend along the longitudinal direction of the open stub line electrode, whereby an FET structure is provided.

A portion of the main line electrode is grounded when the FET is turned on, so that a high frequency signal flowing through the mainline is cutoff. When the FET is turned off, the high frequency signal can flow through the main line electrode. Thus, the switching operation is carried out.

According to the high frequency switch of preferred embodiments of the present invention, the main line electrode does not constitute a part of the FET. Accordingly, the insertion loss occurring when the switch is on can be reduced. The grounded state exhibiting no frequency characteristic is realized. Therefore, the high frequency signal can be cut off with high stability when the switch is off. As a result, a high isolation characteristic can be attained.

Preferably, the semiconductor activation layer is disposed in the portion of the substrate between the side edges of the open stub line electrode ranging from the one-side end thereof to the other-side end thereof and the ground electrode so as to be extended under the open stub line electrode and under the ground electrode, and the gate electrode is arranged on the semiconductor activation layer between the open stub line electrode and the ground electrode so as to extend along the longitudinal direction of the open stub line electrode, whereby an FET structure is provided.

Also, preferably, the semiconductor activation layer is disposed in the portion of the substrate between the side edges at least on the one-end side of the short stub line electrode and the ground electrode so as to be extended under the short stub line electrode and under the ground electrode, and the gate electrode is disposed on the semiconductor activation layer between the short stub line electrode and the ground electrode so as to extend along the longitudinal direction of the short stub line electrode, whereby an FET structure is provided.

Preferably, the semiconductor activation layer is disposed in the portion of the substrate between the side edges of the short stub line electrode ranging from the one-end side to the other-end side thereof and the ground electrode so as to be extended under the short stub line electrode and under the ground electrode, and the gate electrode is arranged on the semiconductor activation layer between the short stub line electrode and the ground electrode so as to extend along the longitudinal direction of the short stub line electrode, whereby an FET structure is provided.

Preferably, the gate electrode is arranged so as to continuously extend from the short stub line electrode side to the open stub line electrode side crossing over the main line electrode.

Preferably, the short stub line electrode and the open stub line electrode, together with the ground electrode, define a coplanar waveguide.

Preferably, the length form the other end of the short stub line electrode to the other end of the open stub line electrode is set to have an electrical length of about 90° with respect to a high frequency signal flowing through the high frequency switch.

Preferably, plural pairs each including the short stub line electrode and the open stub line electrode are provided at predetermined intervals in the longitudinal direction of the main line electrode. Moreover, preferably, the plural pairs of the short stub line electrodes and the open stub line electrodes are provided at intervals of an electrical length of 90° with respect to a high frequency signal flowing through the high frequency switch, in the longitudinal direction of the main line electrode.

Preferably, two pairs each including the short stub line electrode and the open stub line electrode are provided at a predetermined interval in the longitudinal direction of the main line electrode, and regarding the two short stub line electrodes and the main line electrode between the two short stub line electrodes, crossover wirings connecting the ground electrodes existing on both of the sides of the respective line electrodes so as to cross over the line electrodes are not provided. According to this configuration, the lengths of the stub line electrodes can be reduced. Thus, the overall size of the high frequency switch can be decreased. Preferably, regarding the two short stub line electrodes, the side-edges of the respective short stub line electrodes on one side thereof are continuous with the ground electrode. Also, preferably, regarding the two short stub line electrodes, the side-edges of the respective short stub line electrodes on the other sides thereof are continuous with the ground electrode.

Preferably, the ground electrode existing in the area between the two short stub line electrodes is continuous with the main line electrode. Also, preferably, a pair of two open stub line electrodes are provided on both of the sides of the two pairs of the short stub line electrodes and the open stub line electrodes in the longitudinal direction of the main line electrode, respectively, one-side ends of the paired open stub line electrodes being connected to the side edges opposed to each other of the main line electrode, and the other-side ends thereof being opened. Moreover, preferably, a semiconductor activation layer is disposed in the portion of the substrate between the side edges at least on the one-side end sides of the paired open stub line electrodes and the ground electrodes so as to be extended under the open stub line electrodes and under the ground electrodes, and a gate electrode is arranged on the semiconductor activation layer between the open stub line electrodes and the ground electrodes so as to extend along the longitudinal direction of the open stub line electrodes, whereby an FET structure is formed.

Preferably, the one-side ends of the paired open stub line electrodes are connected to the mainline electrode near the connecting points at which the pair of the short stub line electrode and the open stub line electrode adjacent to the paired open stub line electrodes are connected to the main line electrode.

According to various preferred embodiments of the present invention, a high frequency switch includes a plurality of the above-described high frequency switches, one-side ends of the plural high frequency switches being connected to each other via the main line electrode which ranges from the connecting point to the short stub line electrode nearest to the connecting point and from the connecting point to the open stub line electrode nearest to the connecting point and has an electrical length of about 90° with respect to a high frequency signal flowing through the main line.

According to another preferred embodiment of the present invention, an electronic device including the above-described high frequency switch is provided. Thus, the consumption power can be reduced, and the operation error can be minimized.

Other features, elements, characteristics and advantages of the present invention will become more apparent from the following detailed description of preferred embodiments with reference to the attached drawings.

BRIEF DESCRIPTION OF THE DRAWINGS

FIG. 5 is an equivalent circuit diagram obtained when the high frequency switch of FIG. 1 is on;

FIG. 6 is a substantially equivalent circuit diagram obtained when the high frequency switch of FIG. 1 is on;

FIG. 10 is a characteristic graph showing the transmission characteristics of the high frequency switch according to various preferred embodiments of the present invention and those of the high frequency switches of FIGS. 8A, 8B, and 8C, obtained when the switch is on;

FIG. 11 is a characteristic graph showing the reflection characteristics of the high frequency switch according to various preferred embodiments of the present invention and those of the high frequency switches of FIGS. 8A, 8B, and 8C, obtained when the switch is on;

DETAILED DESCRIPTION OF PREFERRED EMBODIMENTS

Figure 1:
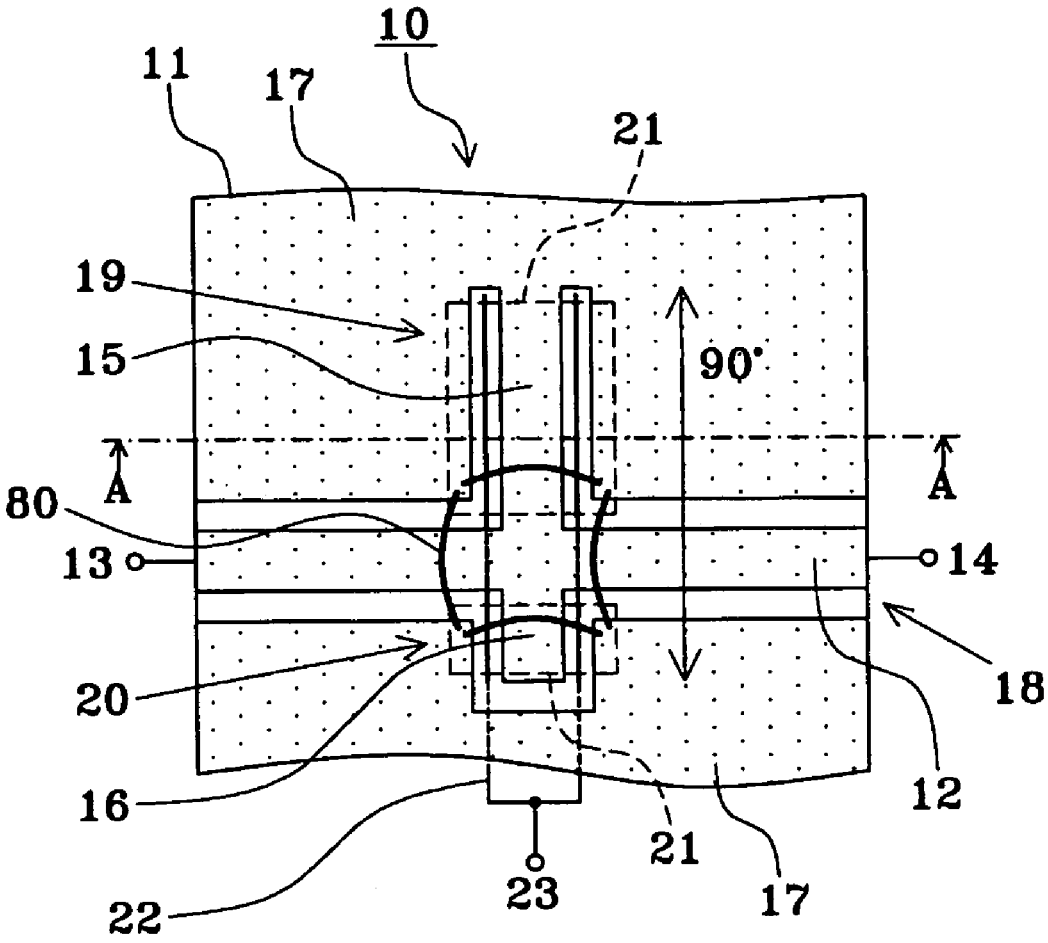
FIG. 1 is a plan view of a high frequency switch according to a preferred embodiment of the present invention.
Figure 2:
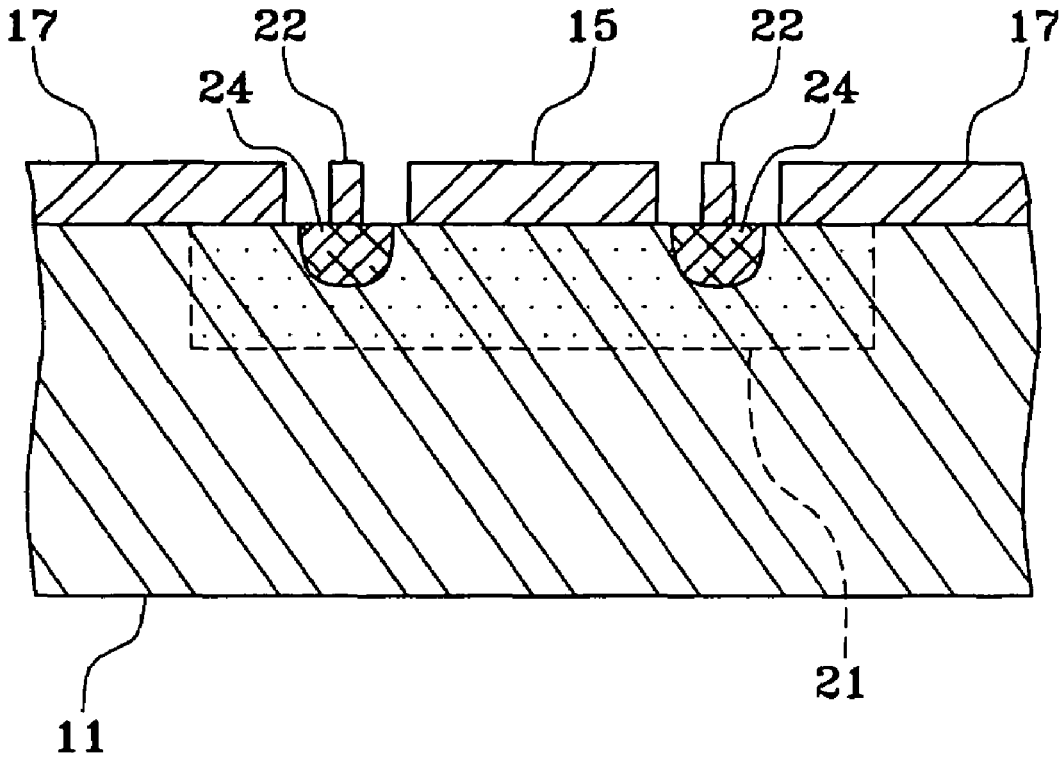
FIG. 2 is an enlarged cross-sectional view of the high frequency switch taken along line A—A in FIG. 1.

FIG. 1 shows a plan view of a high frequency switch according to a preferred embodiment of the present invention. FIG. 2 is an enlarged cross-sectional view taken along line A—A in FIG. 1.

Referring to FIG. 1, a high frequency switch 10 includes a main line 18 having a coplanar waveguide disposed on a semiconductor substrate 11, a short stub 19, and an open stub 20. The main line 18 includes a main line electrode 12 and a ground electrode 17 disposed on both of the sides in the width direction of the main line electrode 12. One end and the other end of the main line 18 are connected to terminals 13 and 14, respectively. The short stub 19 includes a short stub line electrode 15 and a ground electrode 17 disposed on both of the sides in the width direction of the short stub line electrode 15. One end of the short stub line electrode 15 is connected to the side-edge of the main line electrode 12 of the main line 18, and the other end thereof is connected to the ground electrode 17. The open stub 17 includes an open stub line electrode 16 and a ground electrode 17 disposed on both of the sides in the width direction of the open stub line electrode 16. One end of the open stub line electrode 16 is connected to the side edge of the main line electrode 12 of the main line 18. The other end of the open stub line electrode 16 is opened. The side edge of the main line electrode 12 to which the one end of the short stub line electrode 15 is connected, and the other side edge of the main line electrode 12 to which the one end of the open stub line electrode 16 is connected are opposed to each other. Thus, the short stub 19 and the open stub 20 are arranged in opposition to each other via the main line 18.

Generally, in coplanar waveguides, phases are shifted from each other in the ground electrodes provided on both of the sides of a line electrode, which causes a loss in some cases. Especially, in the branch points of a coplanar waveguide, i.e., in the nodes between the main line 18, the short stub 19 and the open stub 20 shown in FIG. 1, phases in the ground electrodes on both of the sides of each line electrodes are shifted. This may cause a loss. Therefore, in all of the four branch points of the high frequency switch 10 shown in FIG. 1, crossover wirings 80 connecting the ground electrodes to each other so as to cross over the line electrodes, respectively. For example, the crossover wirings 80 are wires which connect the ground electrodes 17 at the positions thereof near the line electrodes so as to sandwich the line electrodes. The crossover wirings 80 are not provided only in the branch points of the coplanar waveguide. The wirings may be provided in the portions of the ground electrode 17 excluding the branch points, if necessary. It is preferable to provide the crossover wirings 80, but it is not indispensable. For example, only the wirings crossing over the main line electrode 12 may be provided. Only the wirings crossing over the stub line electrodes may be formed. Moreover, one or three of the four wirings may be provided. In some cases, no wirings may be provided. Wirings having a bridge structure crossing over a line electrode may be provided, or wirings each having another structure, e.g., in which the wiring is extended under the line electrodes may be provided. Moreover, the widths of the wirings have no particular limitations. However, preferably, the widths of the wirings are larger, since the wirings can satisfactorily perform their essential functions.

The distance between the other end (grounded end) of the short stub line electrode 10 and the other end (open end) of the open stub line electrode 16 is preferably set at an electrical length of about 90° with respect to a high frequency signal flowing through the high frequency switch 10. Moreover, in the high frequency switch 10, the length of the short stub line electrode 15 is preferably set to have an electrical length of about 60°, and the length of the open stub line electrode 16 is preferably set to have an electrical length of about 30°. In this case, the length of the short stub line electrode 15 and that of the open stub line electrode 16 include a half of the width of the main line electrode 12, respectively.

A semiconductor activation layer 21 is disposed on the semiconductor substrate 11 between the short stub line electrode 15 and the ground electrode 17, ranging over the whole length of the short stub line electrode 15. Moreover, the semiconductor activation layer 21 is extended under the short stub line electrode 15 and the ground electrode 17. Similarly, the semiconductor activation layer 21 is disposed between the open stub line electrode 16 and the ground electrode 17 ranging over the whole length of the open stub line electrode 16. The semiconductor activation layer 21 also is extended under the open stub line electrode 16 and the ground electrode 17. The portion of the semiconductor substrate 11 where the semiconductor activation layer 21 is not formed is substantially an insulator.

A gate electrode 22 is disposed between the short stub line electrode 15 and the ground electrode 17 and between the open stub line electrode 16 and the ground electrode 17 at least on the semiconductor activation layer 21 so as to continuously extend in the longitudinal direction of the short stub line electrode 15 and the open stub line electrode 16.

The gate electrode 22 is arranged so as to extend from the short stub 19 side to the open stub 20 side, crossing over the main line electrode 12. The gate electrode 22 is connected to a gate voltage input terminal 23 on the other-end side of the open stub line electrode 16. A portion of the wiring ranging from the gate voltage input terminal 23 to the gate electrode 22 overlaps the ground electrode 17. In this range, the wiring and the ground electrode 17 are electrically insulated from each other via an insulation layer or the like. Moreover, for a portion of the wiring crossing over the main line electrode 12, the wiring and the main line electrode 12 are insulated from each other. The gate electrode 22 is depicted as a line in FIG. 1. Practically, as shown in FIG. 2, the gate electrode 22 has some width.

In FIGS. 1 and 2, it is shown that the overall main line electrode 12 is formed directly on the semiconductor substrate 11. However, the inactive portion of the semiconductor substrate 11 is not necessarily a sufficient insulator. Thus, an insulation film is preferably provided between the main line electrode 12 and the semiconductor substrate 11 for prevention of unnecessary leakage.

As shown in the enlarged cross-sectional view of FIG. 2 taken along line A—A in FIG. 1, the electrodes are disposed on both of the sides of the gate electrodes 22, i.e., sandwich the gate electrodes 22 in the region where the semiconductor activation layer 21 is provided. As a whole, this defines an FET structure, more specifically, a normally-on type FET structure. In this case, the short stub line electrode 15 and the open stub line electrode 16 may be set as a drain, and the ground electrode 17 may be set as a source. Needless to say, the reverse structure is available. It is preferable that the gate electrodes 22 are connected to the semiconductor activation layer 21 via Schottky contact, and the short stub line electrode 15, the open stub line electrode 16, and the ground electrode 17 are connected to the semiconductor activation layer 21 via ohmic contact. Thus, depletion layers 24 are preferably disposed in the semiconductor activation layer 21 beneath the gate electrodes 22.

In the high frequency switch 10 having the structure described above, the DC potentials of the drain (the short stub line electrode 15 and the open stub line electrode 16) and the source (the ground electrode 17) are set, e.g., at 0 V, and the DC potential of the gate electrode 22 is set at 0 V. In this case, the gate is not biased with respect to the drain and the source, so that the depletion layer 24 is reduced. Therefore, the drain and the source of the FET structure are substantially short-circuited to each other via the semiconductor activation layer 21 in the range of the whole of the short stub line electrode 15 and the open stub line electrode 16 in the longitudinal direction thereof.

Figure 3:
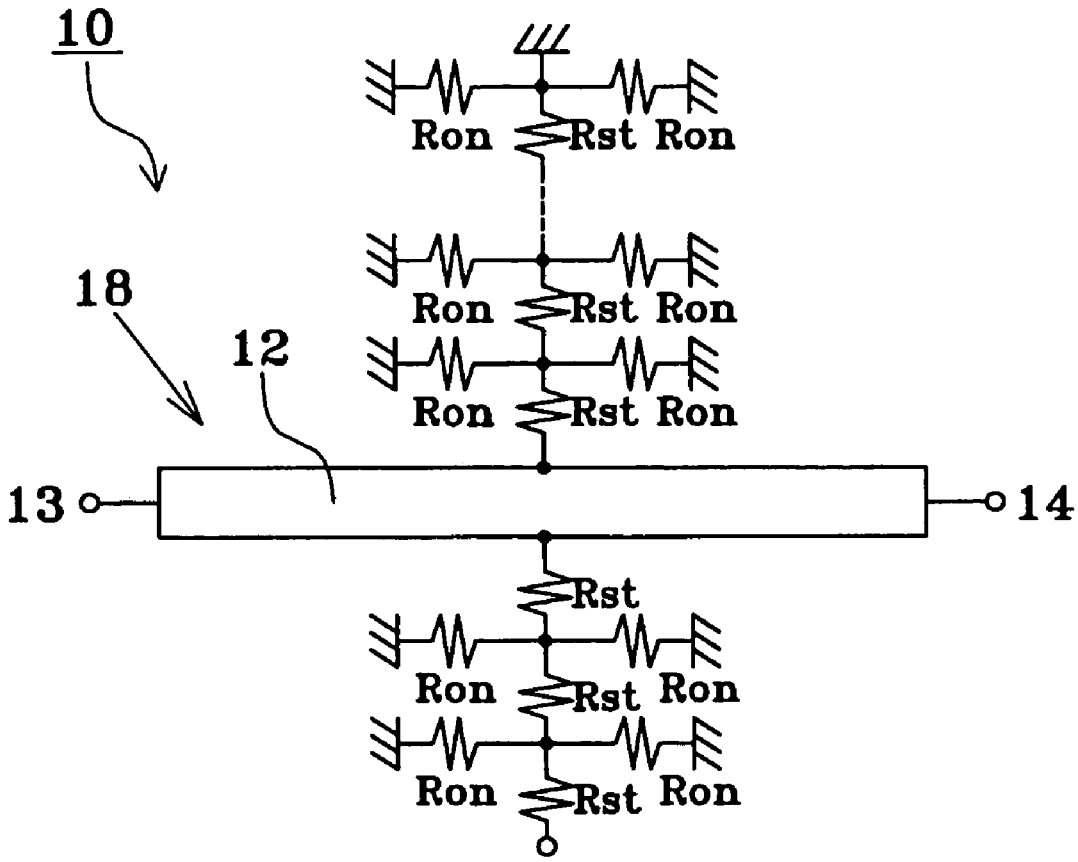
FIG. 3 is an equivalent circuit diagram obtained when the high frequency switch of FIG. 1 is off.
Figure 4:
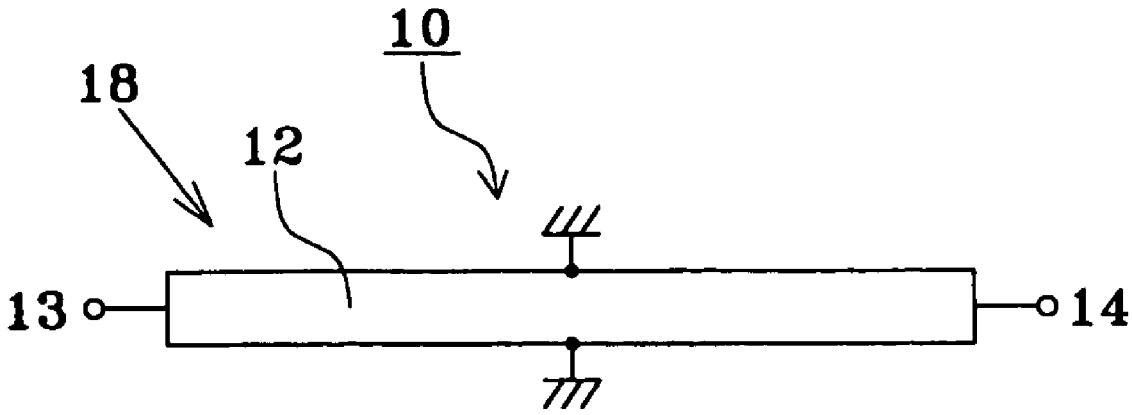
FIG. 4 is a substantially equivalent circuit diagram of the high frequency switch of FIG. 1.

FIG. 3 shows an equivalent circuit of the high frequency switch 10 which is in the above-described state. In FIG. 3, Rst represents the resistance component per unit length of the short stub line electrode 15 or the open stub line electrode 16. Ron is the on-resistance per unit length of the FET portion of the short stub line electrode 15 or the open stub line electrode 16. Practically, an inductance component per unit length of the short stub line electrode 15 or the open stub line electrode 16 exists which is in series with the Rst. However, the inductance component is considerably small and is omitted in this case. The Rst and the Ron have small values. The high frequency switch 10 has a plurality of Rst and Ron connected in series and in parallel. As equivalently shown in FIG. 4, in the high frequency switch 10, the opposed side-edges on both of the sides of the main line electrode 12 are substantially shortcircuited to the ground electrode, the opposed side-edges of the main line electrode being connected to the short stub line electrode 15 and the open stub line electrode 16. In other words, the main line 18 is grounded on the way thereof.

In the above-described state of the high frequency switch 10, a high frequency signal flowing through the high frequency switch 10 is substantially total-reflected at the grounded points. Thus, the signal ceases to be propagated from one end to the other end. In other words, the off-state is caused between the terminals 13 and 14.

On the other hand, the DC potentials of the drain and the source are set, e.g., at 0 V, and the DC potential of the gate electrode 22 is set, e.g., at about −3 V. In this case, the gate is reversely biased with respect to the drain and the source, so that the depletion layer is enlarged, and the semiconductor activation layer 21 is separated. Thus, the drain and the source are cut off.

Figure 5A:
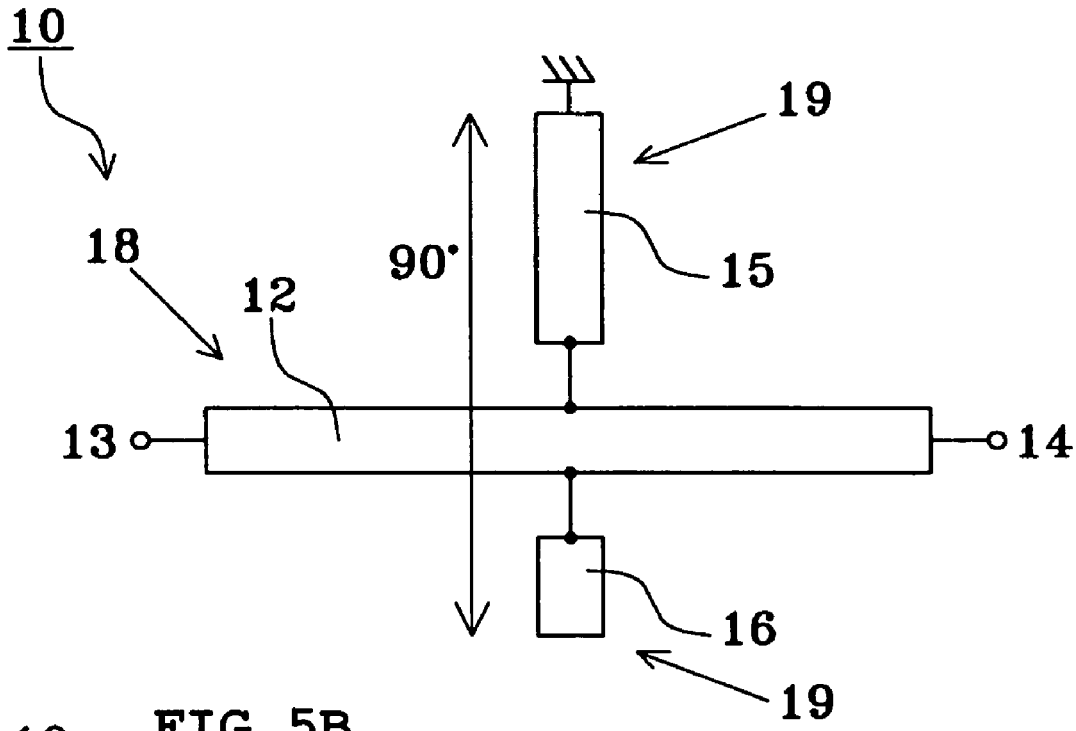
Figure 5B:
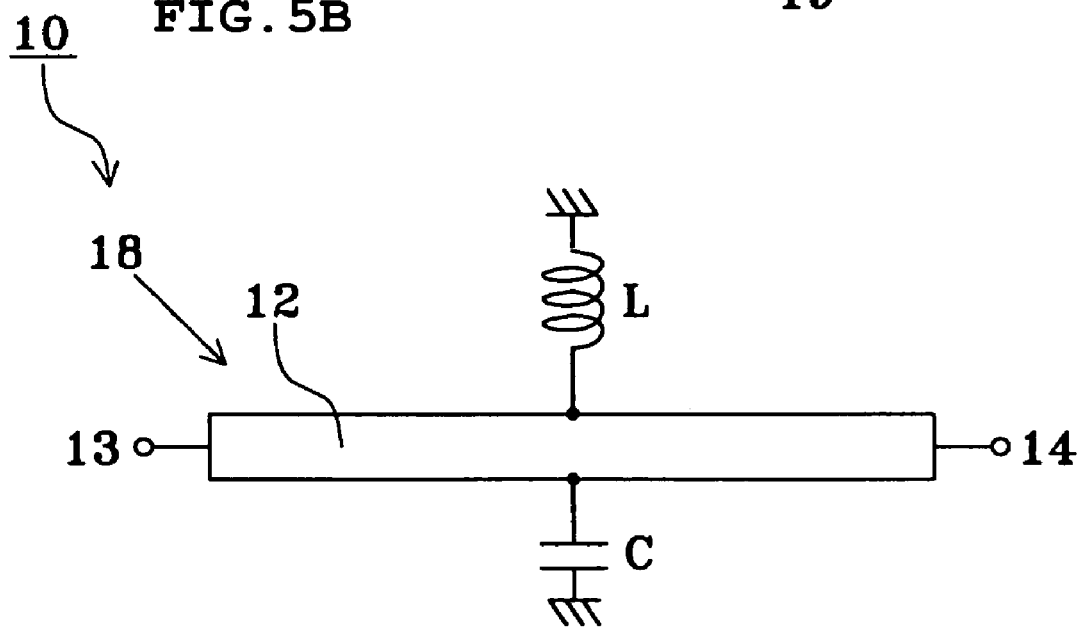
Figure 6:
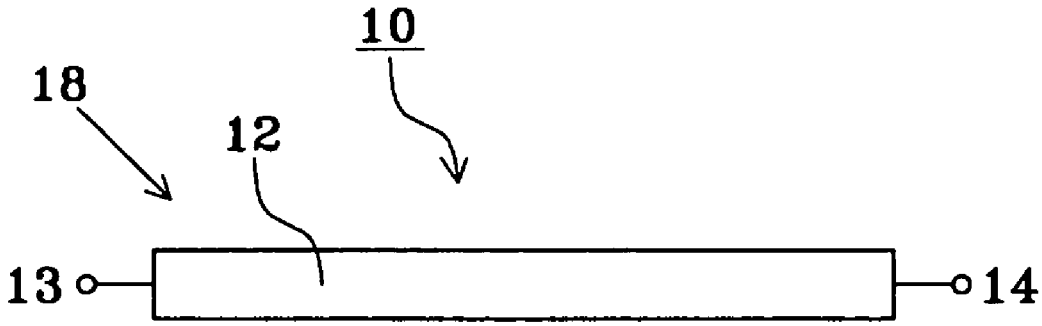

FIGS. 5A and 5B show equivalent circuits of the high frequency switch 10 which are in the above-described state. The equivalent circuit of FIG. 5A is expressed from the standpoint of the distributed constants. FIG. 5B shows the equivalent circuit from the standpoint of the concentrated constants at a signal frequency. Since the FET portion is cut off, the short stub line electrode 15 and the open stub line electrode 16 are simply connected to the main line electrode 12 of the high frequency switch 10. Moreover, the length ranging from the other end of the short stub line electrode 15 to the other end of the open stub line electrode 16 is preferably set at an electrical length of about 90° with respect to a high frequency signal flowing through the high frequency switch 10. Thus, the short stub 19 and the open stub 20 are integrated so as to define a resonance circuit at the frequency of a high frequency signal. Thus, the portion of the main line 18 to which the short stub 19 is connected and the portion of the main line 18 to which the open stub 20 is connected are substantially equivalent to those of the main line 18 to which nothing is connected. Therefore, equivalently, the high frequency switch 10 is made up of the main line 18 only, as shown in FIG. 6.

In this state, the high frequency signal can be freely propagated through the high frequency switch 10. That is, the on-state is caused between the terminals 13 and 14.

As seen in the above-description, switching-operation between the terminals 13 and 14 of the high frequency switch 10 can be carried out by using DC voltage applied to the gate electrode 22.

Figure 7:
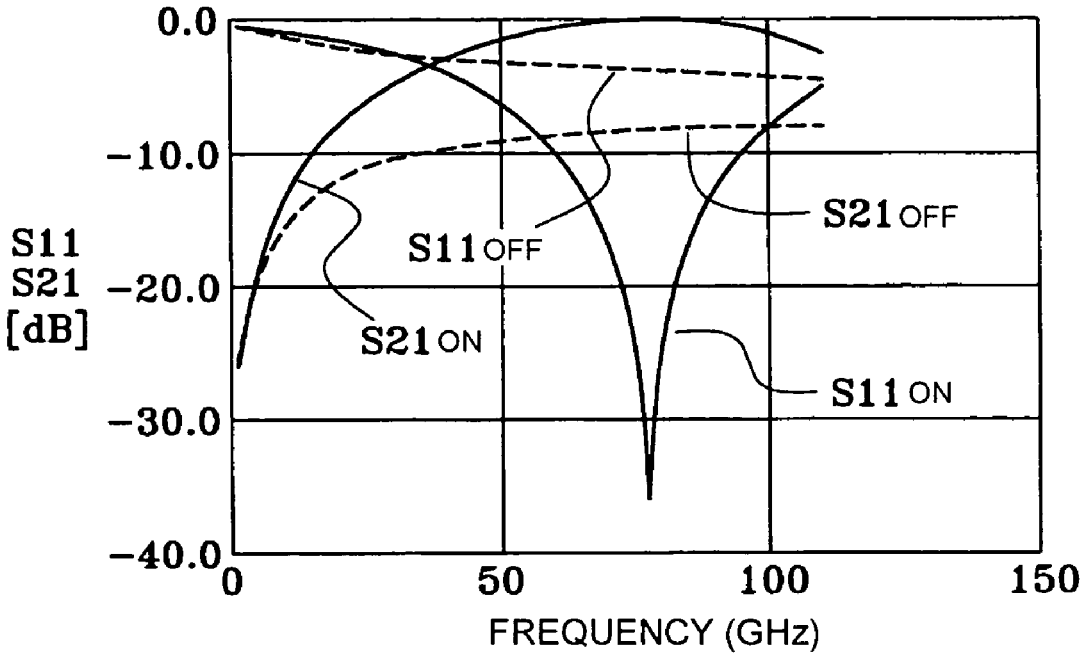
FIG. 7 is a characteristic graph showing the characteristics of the high frequency switch of FIG. 1.

FIG. 7 shows the transmission characteristics S21 and the reflection characteristics S11 exhibited when the high frequency switch 10 is on (the FET is off) and when the high frequency switch 10 is off (the FET is on). In FIG. 7, the solid lines represent the characteristics exhibited when the high frequency switch 10 is on (the FET is off), and the broken lines represent the characteristics exhibited when the high frequency switch 10 is off (the FET is on). The terms ON and OFF in FIG. 7 means ON and OFF of the high frequency switch 10, not ON and OFF of the FET.

As seen in FIG. 7, when the high frequency switch 10 is on, the transmission characteristic S21 is very low, and the reflection characteristic S11 has a value of about −35 dB at 76 GHz which is the frequency of a high frequency signal. Thus, a satisfactory signal transmission characteristic can be obtained. When the high frequency switch 10 is off, the transmission characteristic S21 has a value of about −8 dB, and the reflection characteristic S11 has a value of about −4 dB at a frequency of 76 GHz. Thus, the signal cutoff characteristic is satisfactory, although it is not complete.

According to the high frequency switch 10 having the structure described above, the short stub line electrode 15 and the open stub line electrode 16 are used as a portion of FET, and the main line electrode 12 through which a high frequency signal mainly flows is not a portion of the FET. Accordingly, the following problems, which occur in the case of the high frequency switches of Patent Documents 1, 2 and 3, are not caused: when the high frequency switch 10 is on, a high frequency signal mainly flows through the conductor having a high resistance which is composed of the semiconductor activation layer, so that the insertion loss of the main line is increased.

Moreover, the short stub line electrode 15 and the open stub line electrode 16 are extended in a direction that is substantially perpendicular to the main line electrode 12. Accordingly, the problem which occurs in the high frequency switch of Patent Document 2, that is, the increasing of the switch-size in the longitudinal direction of the main line can be eliminated.

Moreover, the short stub line electrode 15 and the open stub line electrode 16 function as a short stub and an open stub when the FET is off. On the other hand, when the FET is on, they do not function as a short stub and an open stub, respectively. That is, it is not due to the resonance that when the FET is on, a portion of the main line electrode 12 is grounded. Therefore, the lengths of the short stub line electrode 15 and the open stub line electrode 16 are set to have an electrical length between the other end of the short stub line electrode 15 and the other end of the open stub line electrode 16 of about 90°. It is not necessary to consider the conditions of the short stub line electrode 15 and the open stub line electrode 16 caused when the FET is on. Accordingly, the problem occurring in the high frequency switch of Patent Document 4 is not caused.

As described above, the resonance is not utilized when the portion of the main line electrode 12 is grounded. This means that the high frequency switch 10 does not have such a frequency characteristic that the grounding-state is effective at a specified signal frequency. Therefore, when the FET is on, and the high frequency switch 10 is off, the off-state can be maintained in a wide frequency range. In the case of Patent Document 4, the portion of the main line electrode is grounded due to the resonance when the switch is off. That is, the switch operates as a high frequency switch at a specified frequency only. In this point, the high frequency switch 10 of preferred embodiments of the present invention has superior performances. That is, a superior isolation characteristic in a wide frequency range can be obtained. In this case, the isolation characteristic means the characteristic S21 exhibited when the switch is off. Thus, the larger the value by the decibel expression is (the smaller the absolute value is), the better the isolation characteristic is.

Both of the switches according to preferred embodiments of the present invention and described in Patent Document 4 utilize the resonance of the stubs. Thus, no difference exists between the performances of both of the switches.

The configuration in which the short stub and the open stub are arranged in opposition to each other with respect to the main line according to preferred embodiments of the present invention will be described in comparison to the other configurations.

Figure 8A:
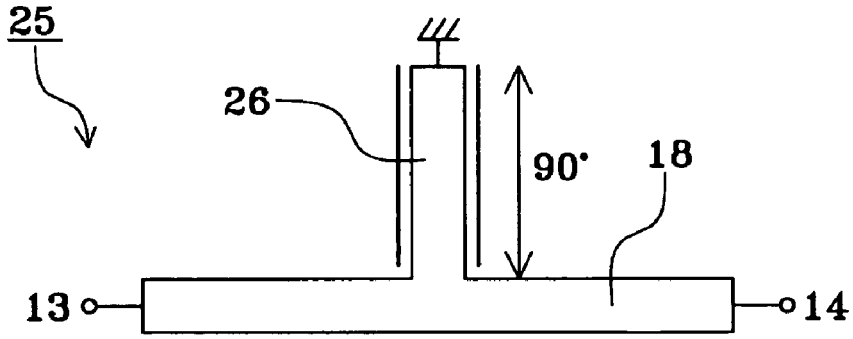
FIGS. 8A, 8B, and 8C are plan views of other high frequency switches which are shown for comparison to the high frequency switch according to various preferred embodiments of the present invention.
Figure 8B:
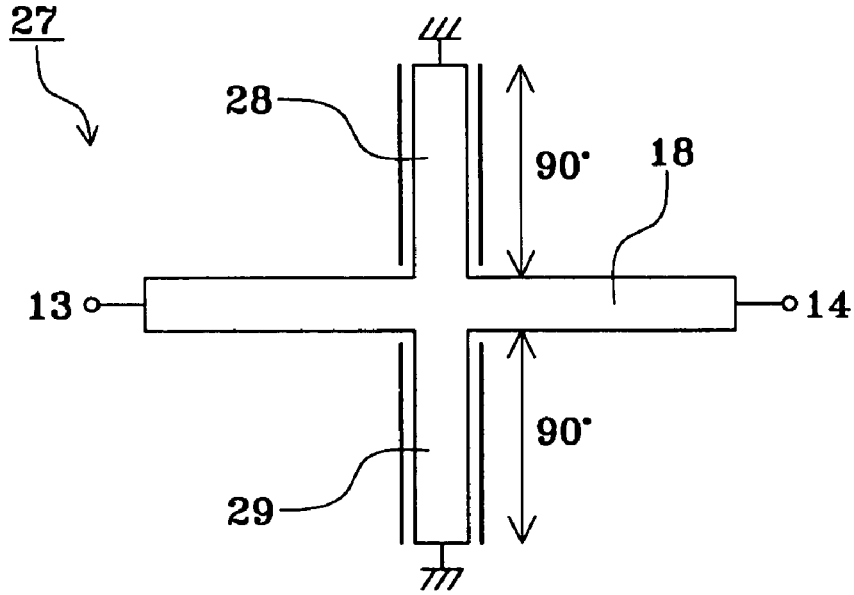
Figure 8C:
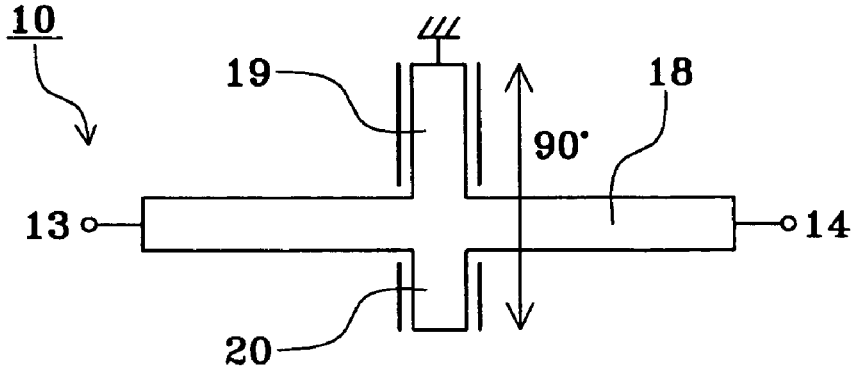

According to the basic concept that a portion of the main line is grounded when the FET is on, and the stubs are connected to the main line when the FET is off, for example, the configurations shown in FIGS. 8A and 8B can be proposed. In FIGS. 8A, 8B, and 8C, the features of the configurations are schematically shown. The ground electrode is omitted. The portion of each gate electrode disposed along the side edges of the stub is shown. First, in a high frequency switch 25 shown in FIG. 8A, only one stub, which is a short stub 26, is connected to a main line 18. Moreover, the overall length of the short stub 26 is preferably set to have an electrical length of about 90° with respect to a high frequency signal. In a high frequency switch 27 shown in FIG. 8B, two stubs connected to the main line 18 are short stubs 28 and 29 opposed to each other, and the overall length of each of the sort stubs 29 and 29 is preferably set to have an electrical length of 90° with respect to a high frequency signal. The high frequency switch 10 according to preferred embodiments of the present invention is schematically shown in FIG. 8C for comparison.

Figure 9:
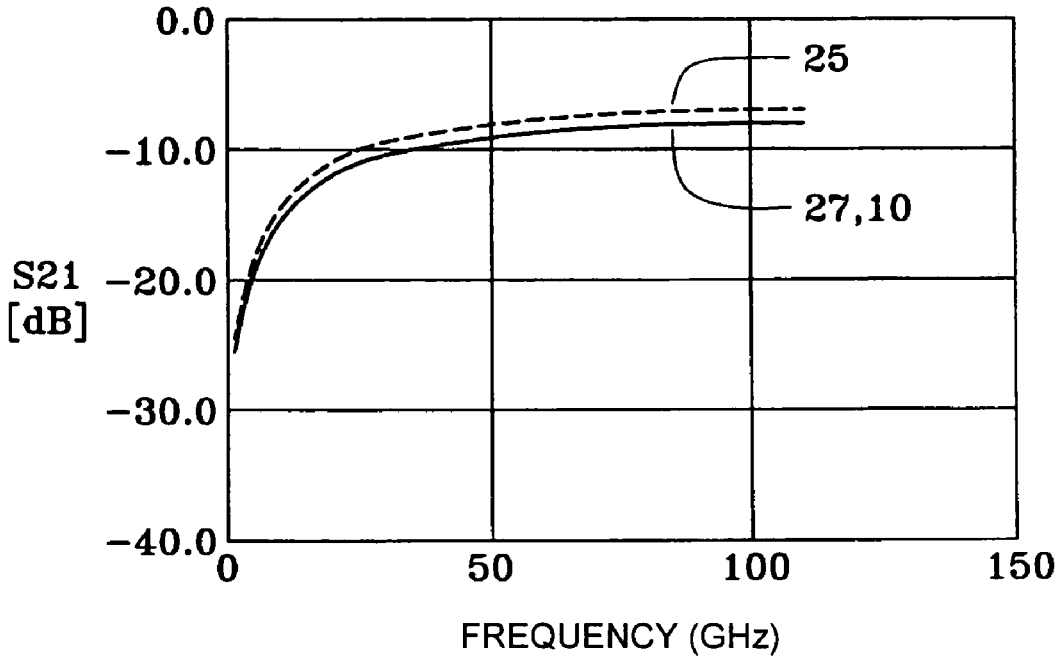
FIG. 9 is a characteristic graph showing the transmission characteristics of the high frequency switch according to various preferred embodiments of the present invention and those of the high frequency switches of FIGS. 8A, 8B, and 8C, obtained when the switch is off.

FIG. 9 shows the transmission characteristics S21 of the high frequency switches 25, 27, and 10 obtained when the switches are off (the FETs are on). In the case where the switch is off, the larger the absolute value by the dB expression is, the better the transmission characteristic S21 is (that is, the isolation characteristic is superior). As seen in FIG. 9, the transmission characteristics S21 of the high frequency switches 27 and 10 are substantially equal to each other, and the transmission characteristic S21 of the high frequency switch 25 is slightly inferior. This is caused by the difference in number between the ground points of the stubs to the main line 18. The numbers of the grounded points of the respective high frequency switches are two, while the number in the high frequency switch 25 is one. The larger the number of grounded points is, the more stable the grounded state is. The isolation is superior. Accordingly, the isolation characteristic of the high frequency switch 10 is superior to that of the high frequency switch 25.

Figure 10:
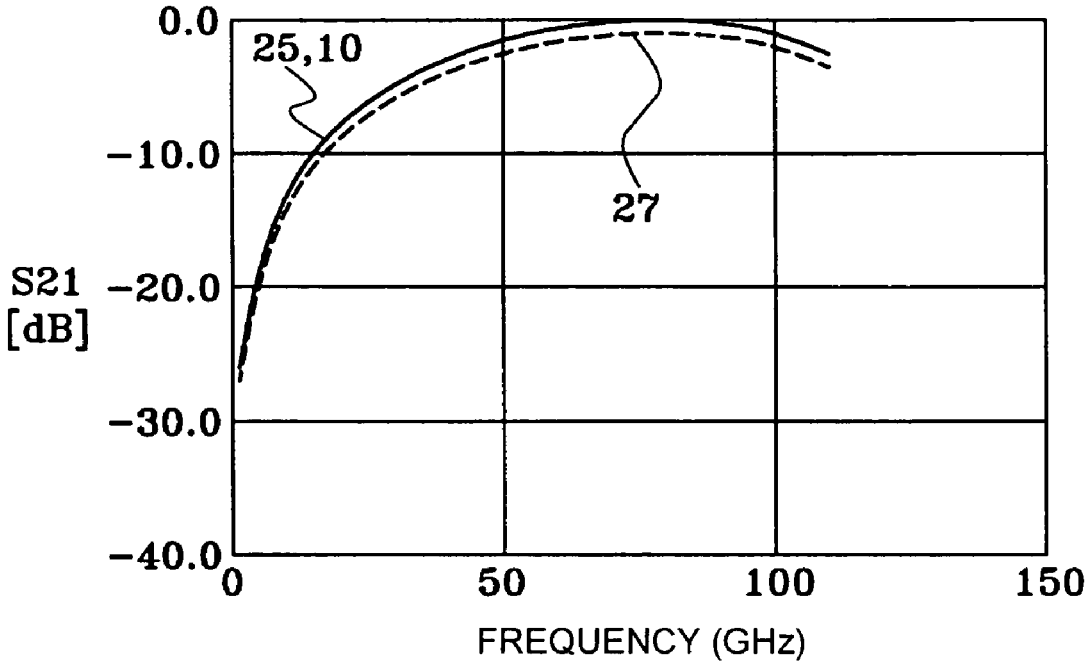

Moreover, FIG. 10 shows the transmission characteristics S21 of the high frequency switches 25, 27, and 10 obtained when the switches are on (the FETs are off). In the case where a switch is on, the smaller the absolute value expressed as dB is, the better the characteristic S21 is (that is, the insertion loss is small). As seen in FIG. 10, the transmission characteristics S21 of the high frequency switches 25 and 10 are substantially equal to each other. The transmission characteristic S21 of the high frequency switch 27 is inferior to that of the respective switches 25 and 10. This is caused by the differences in loss between the stubs as transmission lines. Although the resonance occurs at the frequency of a signal, and it is understood that the stubs are not connected substantially, practically, the high frequency signal flows through the line electrodes of the stubs, so that a loss occurs in the line electrodes. The loss increases with the length of the line electrodes. Therefore, the insertion loss of the high frequency switch 25 is smaller than that of the high frequency switch 27. The length of the line electrodes of the stub is almost equal to that of the high frequency switch 25. Thus, the insertion losses are substantially equal to each other. Accordingly, the insertion loss of the high frequency switch 10 is superior to that of the high frequency switch 27.

Figure 11:
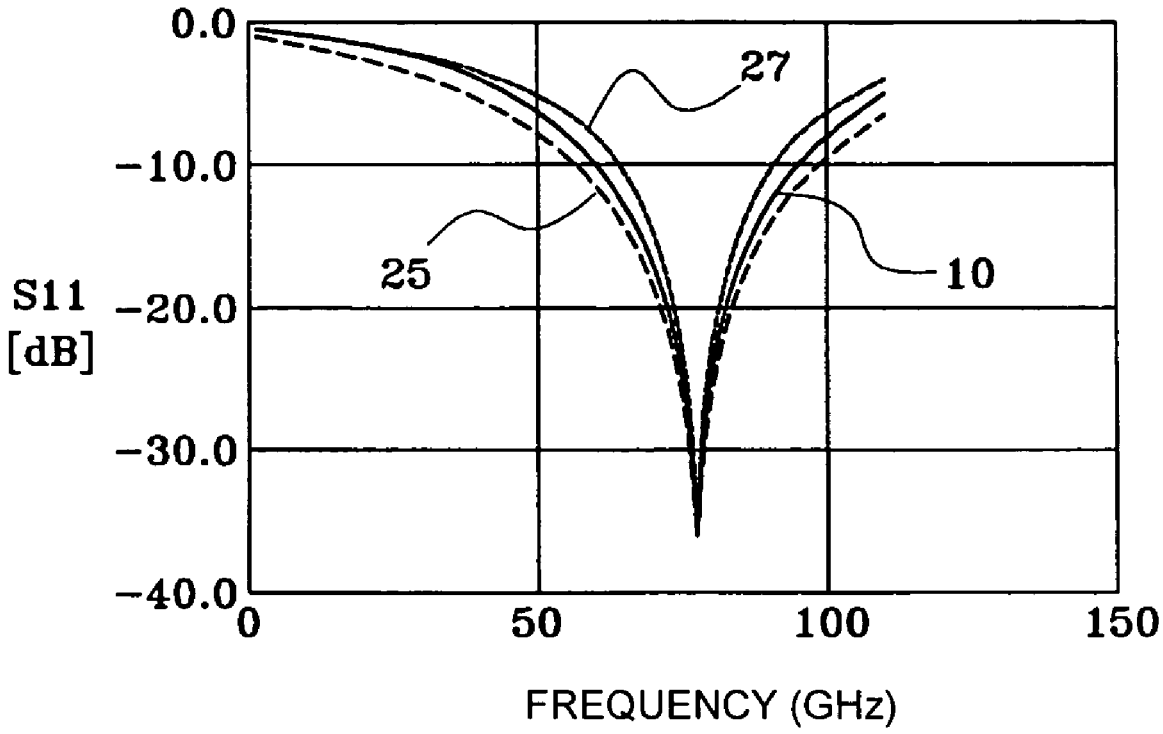

Moreover, FIG. 11 shows the reflection characteristics S11 of the high frequency switches 25, 27, and 10 obtained when the switches are on (the FETs are off). In the case where a switch is on, the larger the absolute value expressed in dB unit is, the better the reflection characteristic S11 is (it is required for the absolute value to be larger than a predetermined value, and thus, it is not necessary that the absolute value is larger). In addition, it is more preferable that the frequency range (bandwidth) in which the characteristic S11 is wider. As seen in FIG. 10, the bandwidth of the high frequency switch 25 is widest, and that of the high frequency switch 27 is smallest. The bandwidth of the high frequency switch 25 is intermediate in size between the bandwidths of the high frequency switches 25 and 27. The reflection characteristics S21 of the high frequency switches 25 and 27 are different from each other. Probably, this is due to the difference between the numbers of the stubs (difference between the numbers of the stages of the resonance circuits). Thus, the bandwidth of the high frequency switch 10 of preferred embodiments of the present invention is smaller than that of the high frequency switch 25, but can be set to be larger than that of the high frequency switch 27. The bandwidth of the high frequency switch 10 according to preferred embodiments of the present invention is larger than that of the high frequency switch 27. The reason will be described below.

As seen in the different configurations of the two high frequency switches 25 and 27, the widths of the switching portions of the high frequency switches 25 and 27 differ from each other by about two times. Thus, the high frequency switch 25 can be more conveniently reduced in size than the high frequency switch 27. In this respect, the width of the high frequency switch 10 according to preferred embodiments of the present invention is substantially equal to that of the high frequency switch 25. Thus, from the standpoints of the occupied areas, the high frequency switch 10 is superior to the high frequency switch 27.

The high frequency switch 10 according to preferred embodiments of the present invention will be totally estimated based on the above-description. In the high frequency switch 10 according to preferred embodiments of the present invention, an insertion loss substantially equal to that of the high frequency switch 25 and a small occupied area can be realized, and in addition, a wide bandwidth characteristic substantially equal to that of the high frequency switch 25 and an isolation characteristic comparable to that of the high frequency switch 27 can be obtained.

Figure 12A:
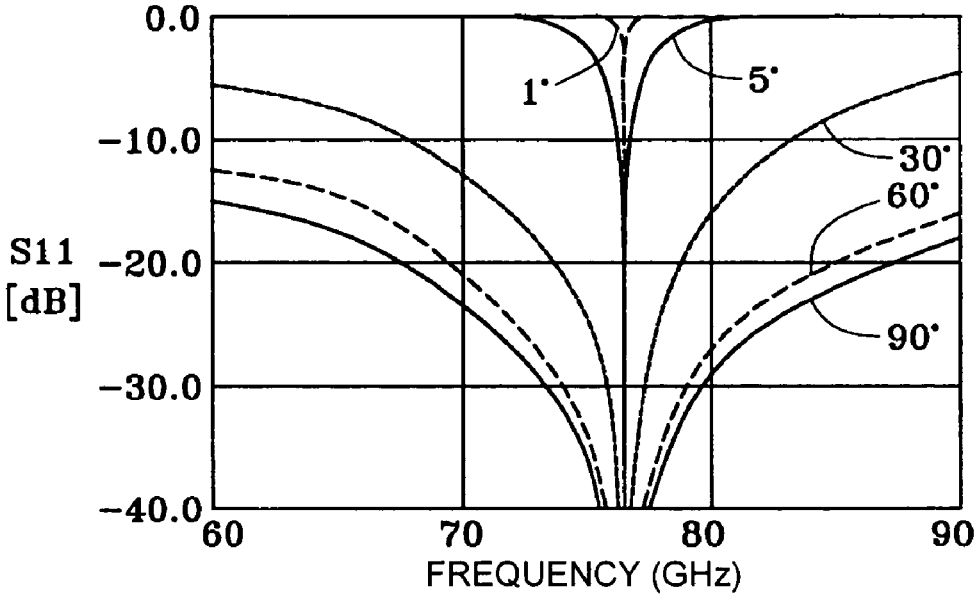
FIGS. 12A and 12B are characteristic graphs showing the relationships between the length of the short stub line electrode included in the high frequency switch according to various preferred embodiments of the present invention and the electrical properties of the high frequency switch.
Figure 12B:
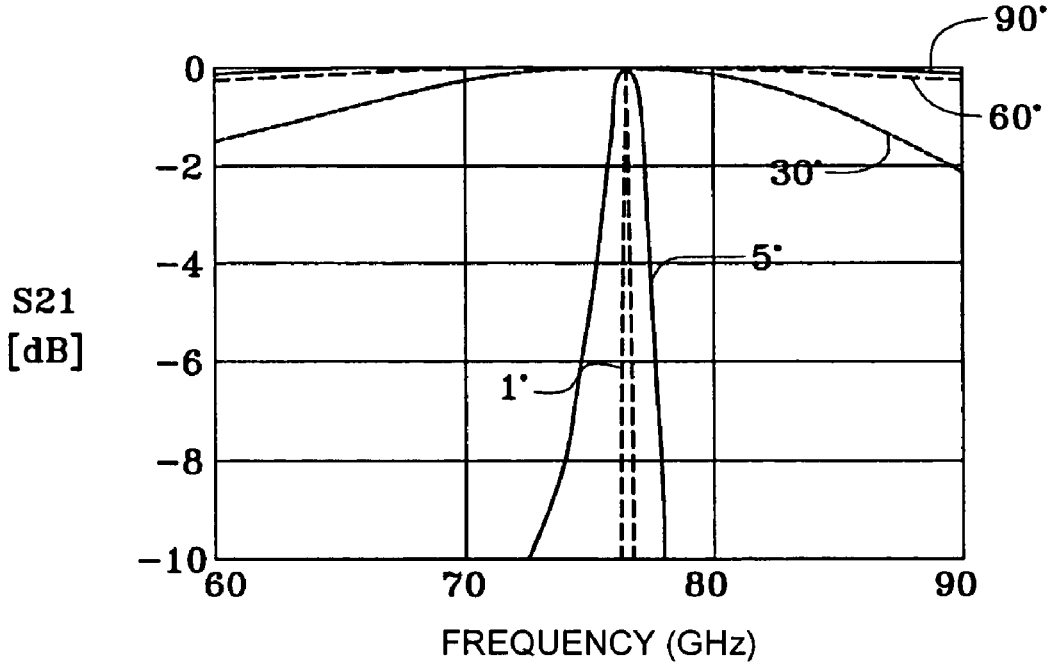

Thereafter, the relationship between the lengths of the short stub line electrode 15 and the open stub line electrode 16 and the electrical characteristics of the high frequency switches will be investigated. FIGS. 12A and 12B show the transmission characteristics S21 and the reflection characteristics S11 obtained by the simulation in the condition that the electrical lengths of the short stub line electrode 15 of approximately 90° (i.e., the same configuration as that of the above-described high frequency switch 25), 60°, 30°, 5°, and 1° (the electrical lengths of the open stub line electrode are 0°, 30°, 60°, 85°, and 89°) when the high frequency switch 10 is on (the FET is off), respectively. As seen in FIGS. 12A and 12B, for both of the transmission characteristics and the reflection characteristics, the longer the electrical lengths are, the wider the bandwidths are. The shorter the electrical lengths are, the smaller the bandwidths are. It seems that practically, the bandwidths are slightly larger than the above-described lengths due to the loss in the stub line electrodes. For practical use, it is preferable to set the electrical length of the short stub line electrode 15 at about 10° or more.

Referring to the open stub line electrode 16, if the electrical length is excessively small, probably, the electrode 16 can not sufficiently function of grounding when the FET is on. Thus, the open stub line electrode 16 is required to have a length larger than a predetermined one. The smallest required length of the open stub line electrode 16 depends on a variety of factors such as used signal frequencies, the sizes of line electrodes and stub electrodes, the dielectric constants of materials, and so forth. For practical application, it is preferable to set the electrical length of the open stub line electrode 16 at about 10° or larger. In this case, it is preferable to set the electrical length of the short stub line electrode 15 at about 80° or smaller. Moreover, from the standpoints of the practical application, the electrical length of the short stub line electrode 15 is preferably in the range of about 30° to about 60°.

Figure 13:
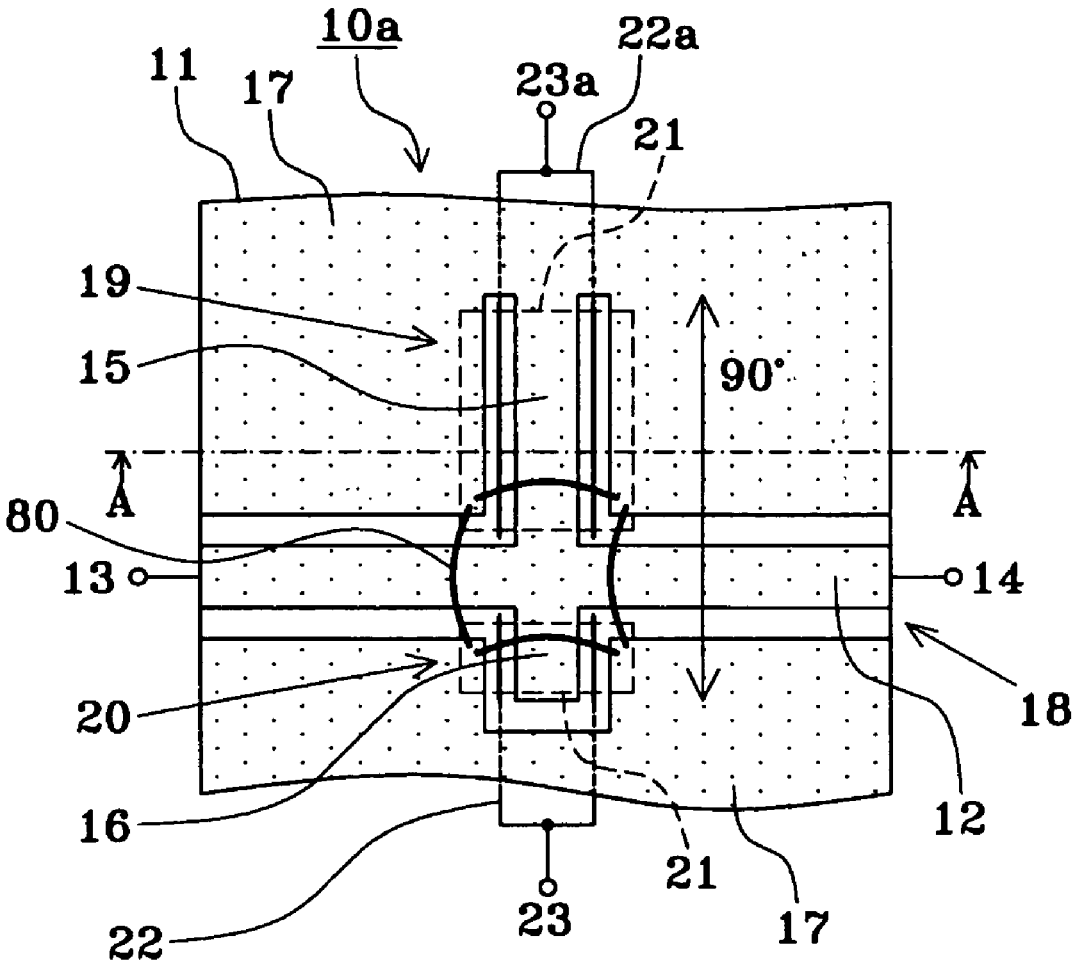
FIG. 13 is a plan view showing another configuration of the high frequency switch according to various preferred embodiments of the present invention in which gate electrodes are provided.

In the high frequency switch 10 shown in FIG. 1, the gate electrode 22 is continuously extended from the short stub 19 side to the open stub 20 side, crossing over the main line electrode 12. On the other hand, as shown in the high frequency switch 10*a* shown in FIG. 13, the gate electrode may be extended on both of the sides, not crossing over the main line electrode 12. The gate electrodes 22 extended on both of the sides of the open stub line electrode 16 along the longitudinal direction thereof is connected to a gate voltage input terminal 23. Moreover, the gate electrodes 22*a* extended on both of the sides of the short stub line electrode 19 along the longitudinal direction thereof is connected to a gate voltage input terminal 22*a*. The high frequency switch having the structure described above can perform or achieve the same operation and effects as the high frequency switch 10.

Referring to the high frequency switch 10 shown in FIG. 1, for the purpose of substantially grounding the main line electrode 12 in the portion thereof which is connected to the short stub line electrode 15 and the open stub line electrode 16, it is required that the one end-sides of the short stub line electrode 15 and the open stub line electrode 16, that is, the sides thereof connected to the main line electrode 12 function as FET in the area thereof ranging some lengths, so that when the FET is on, a portion of the main line electrode 12 can be grounded at a sufficiently low resistance. That is, it is not necessary that FET is produced in the whole area ranging the one end to the other end of the short stub line electrode 15 and from the one end to the other end of the open stub line electrode 16.

Figure 14:
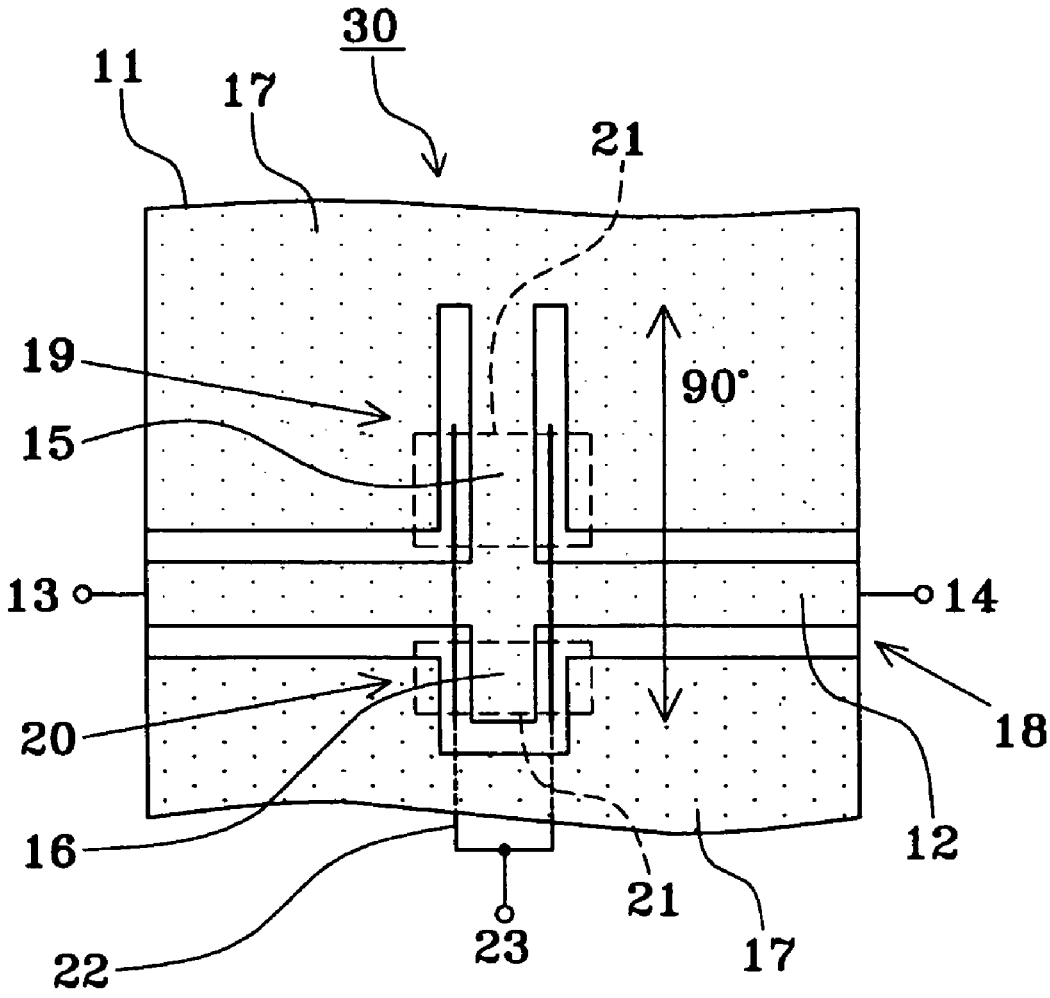
FIG. 14 is a plan view of a high frequency switch according to another preferred embodiment of the present invention.

FIG. 14 is a plan view of a high frequency switch according to another preferred embodiment of the present invention. In FIG. 14, the elements which are the same as or equivalent to those shown in FIG. 1 are designated by the same reference numerals, and the description is not repeated.

In a high frequency switch 30 shown in FIG. 14, the size of the semiconductor activation layer 21 on the short stub 19 side of the high frequency switch 10 as shown in FIG. 1 is decreased to about a half of the size of the short stub line electrode 15 on the one end-side thereof. Moreover, the length of the gate electrode 22 is set to be slightly longer than that of the semiconductor activation layer 21. The description on the crossover wirings which connect the ground electrodes crossing the line electrodes, respectively, is omitted.

Figure 15:
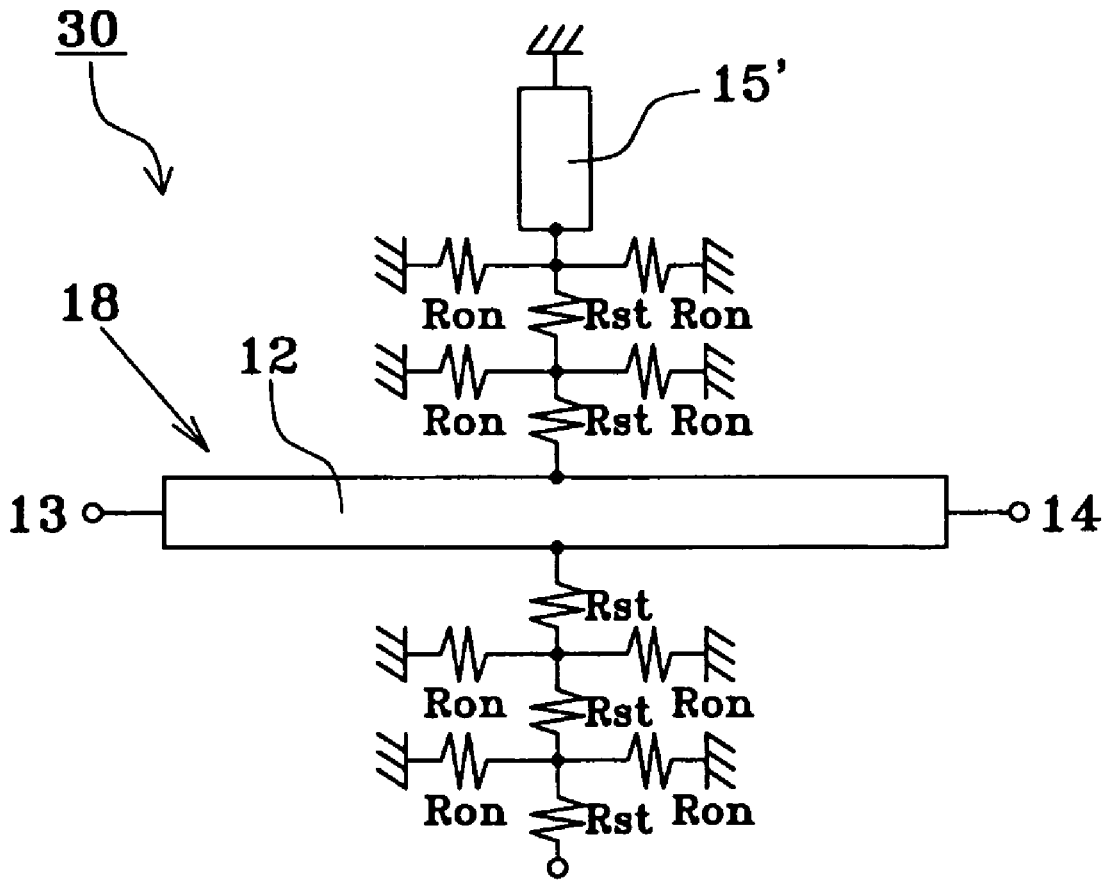
FIG. 15 is an equivalent circuit diagram of the high frequency switch of FIG. 14, obtained when the switch is off.

Referring to the high frequency switch 30 configured as described above, the portion thereof which has an FET structure can operate in the same manner as that of the high frequency switch 10. FIG. 15 shows an equivalent circuit obtained when the FET is on. In FIG. 15, the elements thereof which are the same as or equivalent to those shown in FIG. 3 are designated by the same reference numerals.

In FIG. 15, the portion of the short stub line electrode 15 which does not function as a portion of the FET defines a line electrode 15'. On the other hand, the portion on the one end side of the short stub line electrode 15, which is connected to the main line electrode 12, is connected to the ground electrode 16 via many Tsts and Rons similarly to the case of the high frequency switch 10. Accordingly, in the high frequency switch 30, equivalently, the side edge of the main line 12 connected to the short stub line electrode 15 and the open stub line electrode 16 is substantially short-circuited to the ground electrode 17, similarly to the case of the high frequency switch 10. That is, the main line 18 is grounded on the way thereof.

In the above-described state, a high frequency signal flowing through the high frequency switch 30 is totally reflected at the grounding point, so that the signal does not propagate. That is, the off-sate is caused between the terminals 13 and 14.

On the other hand, when the FET is off, the FET portion is cut off. Thus, in the high frequency switch 30, the short stub line electrode 15 and the open stub line electrode 16 are simply connected to the main line electrode 12. Thus, the high frequency switch 30 operates in the same manner as the high frequency switch 10.

It is required that the length of the gate electrode (gate width) is such that it can cause a sufficiently shortcircuited state for the ground electrode 17, when the FET is on the one-end side of the short stub line electrode 15. Thus, the length of the gate electrode is not restricted to about a half of the stub line electrode as in the high frequency switch 30. The length may be more or less than a half of the stub line electrode.

When the FET is off, an off-capacity exists in distribution between the drain and the source. Therefore, referring to the distributed capacity between the short stub line electrode 15 and the ground electrode 17, the portion thereof where the semiconductor activation layer 21 is present and the portion thereof where no semiconductor activation layer 21 is present have different distributed capacities. Moreover, strictly, the distributed inductance component of the short stub line electrode 15 is varied depending on whether the short stub line electrode 15 is positioned on the semiconductor activation layer 21 or not. Therefore, it is supposed that the characteristic impedance varies depending on the position of the short stub 19 of the high frequency switch 30. Accordingly, it is necessary to set the length and width of the short stub line electrode 15 considering the above-described partial change of the characteristic impedance of the short stub 19.

Practically, in some cases, it is necessary to adjust the electrical length by changing not only the whole length of the short stub line electrode but also the width thereof depending on whether the short stub line electrode constitutes a portion of the FET or not, and also by changing the interval between the short stub line electrode and the ground electrode.

Moreover, in the high frequency switch 10, the gate width, which is the length of the gate electrode, is small compared to that of the high frequency switch 10. Therefore, the off-capacity produced between the drain-source of the FET portion is small. The off-capacity has a relationship to the time constant which determines the speed of the switching operation of the high frequency switch 10 and 30. That is, the smaller the off-capacity is, the smaller the time-constant is. Thus, the speed of the switching operation increases. Therefore, advantageously, the high frequency switch 30 can cope with high speed switching operation compared to the high frequency switch 10.

Typically, the gate electrodes are preferably arranged in straight line patterns. It is difficult to configure the gate electrodes in a bent shape. Thus, in the high frequency switch 10, it is necessary to configure the short stub line electrode 15 in a straight line pattern. In this case, it is difficult to decrease the size of the high frequency switch.

Figure 16:
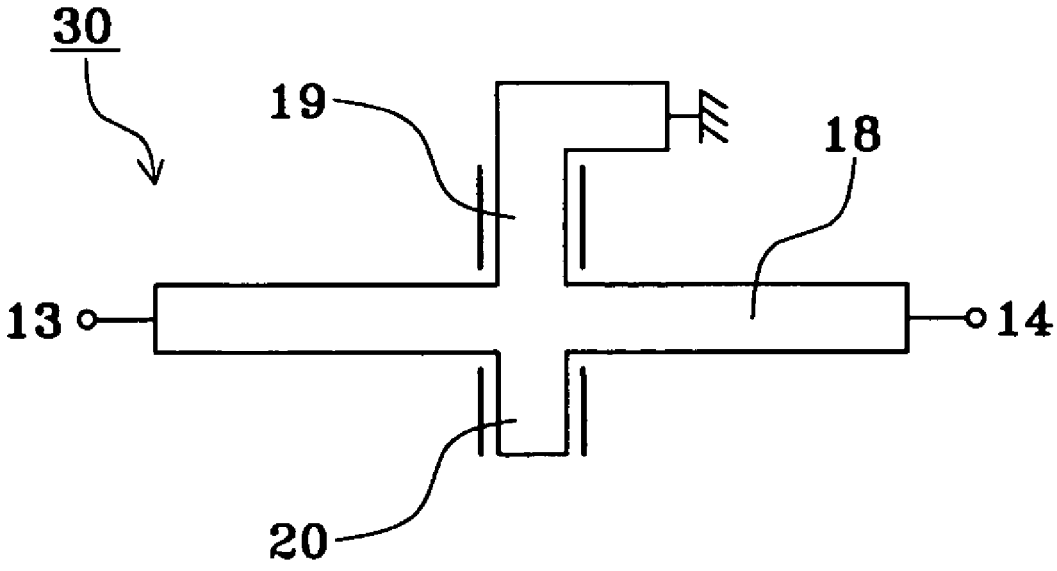
FIG. 16 is a plan view showing another variation of the high frequency switch of FIG. 14.

On the other hand, in the high frequency switch 30, the gate electrode 22 may be disposed along the short stub line electrode 15 on only one end side thereof. Therefore, as shown in the schematic view of FIG. 16, no gate electrode 22 is provided on the other end side of the short stub line electrode 15. Thereby, the size of the high frequency switch is reduced.

As described above, advantageously, the high frequency switch 30 is capable of performing higher speed switching operation as compared to the high frequency switch 10, and in addition, the high frequency switch 30 is bent so as to further reduce the size thereof.

In the high frequency switches 10 and 30, the FET structures are disposed on both sides of the short stub line electrode and the open stub line electrode. However, the FET structure may be provided on only one side of each of the short stub line electrode and the open stub line electrode. In this case, the resistance caused when the FET is on is increased to some degree. In other respects, this structure achieves substantially the same operation and effects as those of the above-described preferred embodiment.

In the high frequency switches 10 and 30, the main lines, the short stubs, and the open stubs are symmetrical waveguides. In each stub, the ground electrode provided for the symmetrical waveguide is used as the source electrode of the FET. However, the main lines, and the stubs are not limited to coplanar waveguides. For example, a waveguide having a ground electrode provided on only one side thereof, i.e., an asymmetrical waveguide may be provided. Moreover, another transmission line not provided with a ground electrode along a line electrode, such as a microstrip line or other suitable transmission line may be provided. In this case, it is necessary to provide a ground electrode in the vicinity of each stub line electrode. In this case, the characteristic impedance of the stub is changed due to the ground electrode provided in the vicinity thereof, in contrast to an ideal microstrip line. This must be taken into account when the length of the stub line is determined. In other respects, the above-described switch as a high frequency switch achieves substantially the same operation and effects as the above-described preferred embodiment.

Moreover, in the respective high frequency switches 10 and 30, the gate electrode is arranged so as to continuously extend from the short stub line electrode 15 side to the open stub line electrode 16 side, crossing over the main line electrode 12. However, this structure is restrictive. The gate electrode may be separated into two portions thereof exiting on the short stub line electrode side and on the open stub line electrode side, provided that the portions of the gate electrode are simultaneously controlled.

Moreover, in the respective high frequency switches 10 and 30, the FET structure is a normally on-type. However, a normally off-type FET structure may be employed. This high frequency switch is the same as each of the high frequency switches 10 and 30 except for the manner in which the voltage is applied.

Hereinafter, another preferred embodiment of the high frequency switch using the stubs in which the above-described FET structure is provided will be described. In the preferred embodiment described below, the same stub structure as in the high frequency switch 30 is provided. Alternatively, the same stub structure as in the high frequency switch 10 may be provided.

Figure 17:
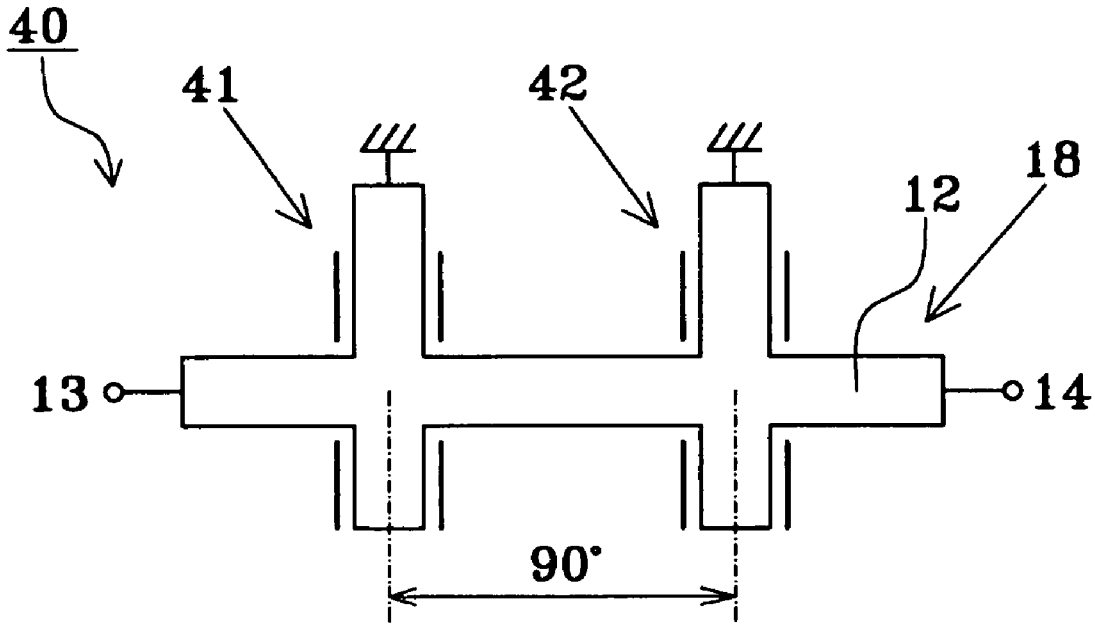
FIG. 17 is a plan view of a high frequency switch according to still another preferred embodiment of the present invention.

FIG. 17 schematically shows another preferred embodiment of the high frequency switch according to the present invention. FIG. 17 is a schematic view of the high frequency switch showing only the features thereof. In FIG. 17, the parts which are the same as or equivalent to those in FIG. 1 are designated by the same reference numerals, and the description is omitted.

As shown in FIG. 17, two pairs of short stubs and open stubs 41 and 42 are connected to the main line electrode 12 at locations which are separated from each other by an electrical length of 90° in the longitudinal direction. In the respective pairs 41 and 42 of short stubs and open stubs, the same FET structure as that provided in the short stub 19 and the open stub 20 of the high frequency switch 30 is produced. The pairs 41 and 42 perform the same function as that of the FET structure provided in the short stub 19 and the open stub 20. The lines provided on both of the sides of the line electrode of the respective stubs represent gate lines. It is to be noted that the ground electrode and the gate voltage input terminals are omitted.

Referring to a high frequency switch 40 configured as described above, the FETs provided in the two pairs of short stubs and open stubs are turned off-on at the same time, corresponding to the on-off of the high frequency switch 40. Thereby, when the high frequency switch is off, the side edges opposed to each other of the main line electrode 12 which disposed on the main line electrode 12 and are separated from each other by an electrical length of 90° are grounded. By grounding two positions separated from each other in the longitudinal direction of the main line electrode 12, a high frequency signal is entirely reflected, and thus, the high frequency switch 40 is cut off, even where the grounding by one pair of the short stub and the open stub is not sufficient. Moreover, the two pairs of the short stubs and the open stubs are connected to the main line electrode 12 at locations thereof that are separated from each other by an electrical length of 90° in the longitudinal direction. Therefore, the impedance of the other pair of the stubs determined based on one pair of the stubs becomes infinite, and does not appear. Therefore, a signal reflected by one pair of the stubs does not exert hazardous influences over the characteristics of the other pair of the stubs, especially, the grounding state thereof.

As described above, in the high frequency switch 40, the cutoff characteristic of the high frequency switch 40 when the switch is off is further enhanced as compared to that of the high frequency switch 30.

In the high frequency switch 40, two pairs of the short stubs and the open stubs in which the FET structures are arranged are provided. At least three pairs of short stubs and open stubs may be used, provided that the pairs of the short stubs and the open stubs are connected to the main line electrode 12 at locations that are separated from each other at an interval of an electrical length of 90°.

In the high frequency switch 40, two stubs are connected to the main line electrode 12 at locations so as to be separated from each other in the longitudinal direction by an electrical length of 90° to prevent the mutual influences. Alternatively, the respective stubs may be disposed near each other.

Figure 18:
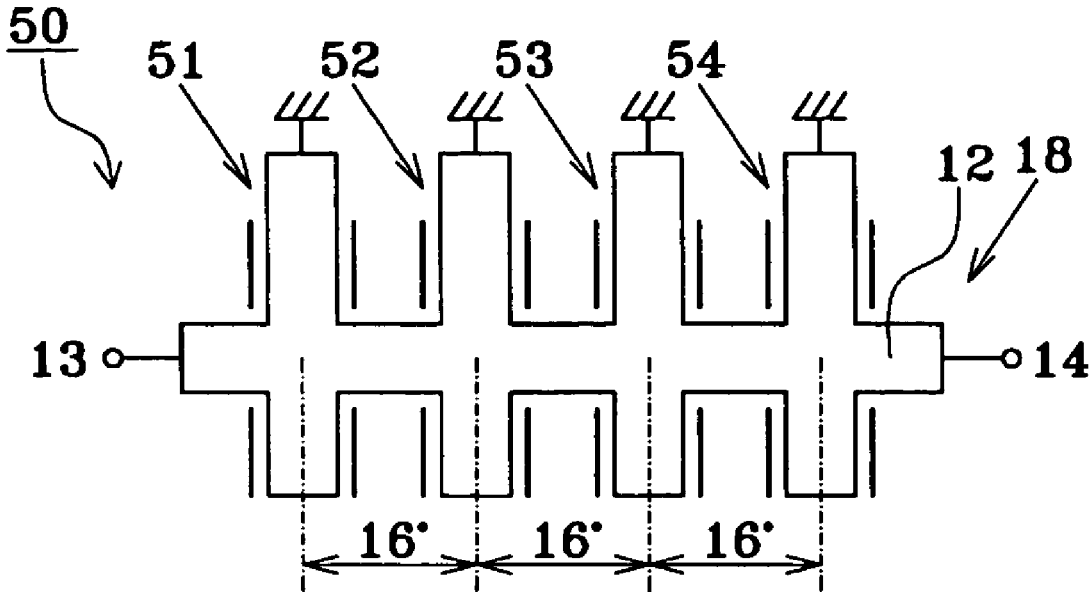
FIG. 18 is a plan view of a high frequency switch according to yet another preferred embodiment of the present invention.

FIG. 18 is a schematic view of still another preferred embodiment of the high frequency switch of the present invention. FIG. 18 schematically shows only the features of the high frequency switch. The parts which are the same as or equivalent to those of FIG. 1 are designated by the same reference numerals, and the description is omitted.

In a high frequency switch 50 shown in FIG. 18, pairs 51, 52, 53, and 54 of short stubs and open stubs are provided, in which FET structures are provided similarly to the sort stub 19 and the open stub 20 in the high frequency switch 10. The lines provided on both of the sides of each of the line electrodes of the stubs represent gate lines. The description of the ground electrode and the gate voltage input terminal is omitted.

As shown in FIG. 17, four pairs 51, 52, 53, and 54 of short stubs and open stubs are connected to the main line electrode 12 at locations that are separated from each other at intervals of an electrical length of 16° in the longitudinal direction of the main line electrode 12. In the high frequency switch 50 configured as described above, the pairs 51, 52, 53, and 54 of short stubs and open stubs perform the same function as that of a pair of the short stub and the open stub in the high frequency switch 30, respectively.

Also, in the high frequency switch 50, the four pairs of the stubs are switch off-on at the same time corresponding to the on-off of the high frequency switch 50. Thereby, the main line electrode 12 is grounded in four locations thereof, when the high frequency switch is off. By grounding in the four positions as described above, the grounded state is ensured, and thus, a high frequency signal is more completely reflected. Thus, the high frequency switch 50 is cut off.

In the high frequency switch 50, the intervals between the respective pairs of stubs in the longitudinal direction of the main line electrode 12 are set at 16°. Accordingly, there are not given such advantages that the respective pairs do not appear for each other, which can prevent the mutual hazardous influences. On the other hand, when the FETs are off (the switch is on), the frequency bandwidth with respect to the reflection characteristic is increased, such that matching can be realized at another frequency. Moreover, the intervals between the respective pairs of stubs are short, such that the size in the longitudinal direction of the high frequency switch is decreased. In addition, since the length of the main line is relatively large, the insertion loss occurring when the switch is on is reduced.

Moreover, since the number of the pairs of stubs is large, the power consumption of each pair of stubs is increased when the FETs are on, due to the reflection of a high frequency signal between the respective pairs of stubs and the grounding resistances of the pairs of stubs. Thereby, advantageously, the insertion loss occurring when the switch is off is increased.

As seen in the above-description, the cutoff characteristic of the high frequency switch 50 caused when the switch is off is further enhanced as compared to that of the high frequency switch 40.

In the high frequency switch 60, the intervals between the pairs are set at about 16°. This is an example. The intervals may be optionally set, if necessary. Moreover, the number of stubs may be optionally set, provided that the number is at least two.

In the above-described high frequency switch shown in FIG. 17, the two pairs of the short stub line electrodes and the open stub line electrodes are connected to the main line electrode at the locations thereof separated from each other in the longitudinal direction of the main line electrode. Each pair of the short stub line electrode and the open stub line electrode is arranged based on the basic configuration shown in FIG. 10. That is, in the case where the pair is arranged based on coplanar lines, essentially, crossover wirings are provided in the four branch points of the basic configuration so as to cross over the line electrodes, respectively, if necessary.

Where plural pairs of the short stub line electrodes and the open stub line electrodes are provided near each other, the operation and the characteristics of the high frequency switch are affected by the arrangement and the presence or absence of the crossover wirings in some cases.

Hereinafter, still another preferred embodiment of the high frequency switch according to the present invention will be described below, involving the arrangement of the crossover wirings.

Figure 19:
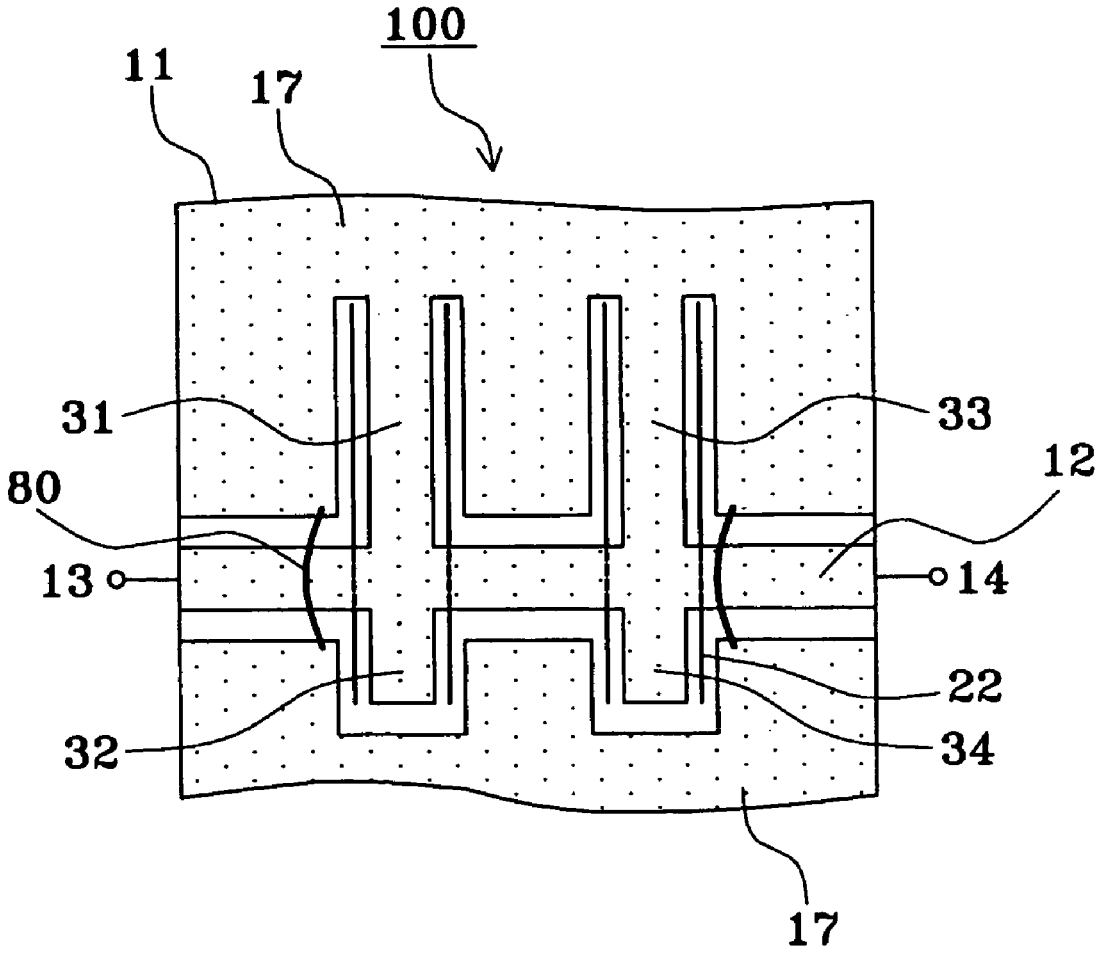
FIG. 19 is a plan view of a high frequency switch according to a further preferred embodiment of the present invention.

FIG. 19 is a plan view of a high frequency switch according to the still another preferred embodiment of the present invention. In FIG. 19, the parts which are the same as or equivalent to those shown in FIG. 1 are designated by the same reference numerals. The description thereof is omitted. Moreover, the area where the semiconductor activation layer is provided, the gate voltage input terminal, and the connection from the gate electrode to the gate voltage input terminal are not illustrated in order to make the drawing simple and clear. Thus, the gate electrode is simply shown. Accordingly, it should be understood that the semiconductor activation layer is provided in the area where the gate electrode is provided, and the connection from the gate electrode to the gate voltage input terminal is carried out.

In a high frequency switch 100 shown in FIG. 19, two pairs of short stub line electrodes and open stub line electrodes, i.e., a pair of a short stub line electrode 31 and an open stub line electrode 32, and a pair of a short stub line electrode 33 and an open stub line electrode 34 are arranged so as to be separated from each other at a predetermined interval in the longitudinal direction of the main line electrode 12. The FET structures are provided on both sides of the stub line electrodes in the two pairs of the short stub line electrodes and the open stub line electrodes, similar to the pair of the short stub line electrode 15 and the open stub line electrode 16. However, in each pair of the short stub line electrode and the open stub line electrode, the length between the other terminal (grounding terminal) of the short stub line electrode and the other terminal (open terminal) of the open stub line electrode is set to exhibit an electrical length of 90° or less for a high frequency signal flowing through the high frequency switch 100.

With respect to the eight branch points of the line electrodes in the high frequency switch 100, crossover wirings are provided so as to extend between the branch points on the left side (in the drawing) of the pair of the short stub line electrode 31 and the open stub line electrode 32 and between the branch points on the right side (in the drawing) of the pair of the short stub line electrode 33 and the open stub line electrode 34, each wiring crossing over the main line electrode 12 to connect the ground electrodes to each other. No crossover wirings are provided for the other branch points. Especially, referring to the two short stub line electrodes 31 and 33, and the mainline electrode 12 existing between the short stub line electrodes 31 and 33, no crossover wiring connecting the ground electrodes on both of the sides of each line electrode, crossing over the line electrode is provided. Accordingly, crossover wirings connecting the ground electrodes, crossing over the open stub line electrodes may be provided. It is preferable to provide the crossover wirings, although they are not shown for simple, clear illustration. These points are true of any of the following preferred embodiments.

As described above, the overall length of the short stub line electrode and the open stub line electrode of each pair is decreased, and the positions of the crossover wirings are restricted. In these points, the high frequency switch 100 is remarkably different from the high frequency switch shown in FIG. 17 which also includes two pairs of the short stub line electrodes and the open stub line electrodes.

Hereinafter, the operation of the high frequency switch 100 will be described. First, the operation of the high frequency switch 100 when the FET parts of the respective stub line electrodes are on is substantially the same as that of the high frequency switch shown in FIG. 17. On the other hand, when the FET parts are off, the operation of the high frequency switch 100 is different from that of the high frequency switch shown in FIG. 17.

Generally, in coplanar waveguides, the electric field distributions between a line electrode and ground electrodes on both of the sides of the line electrode are symmetrical. This is effective where the conditions of the ground electrode are ideal. If the potentials of the ground electrodes on both of the sides are different from each other, the electric field distributions become asymmetrical. Thus, the coplanar line does not function properly.

In the high frequency switch 100, no crossover wiring which connects the ground electrodes to each other crossing over the main line electrode 12 is provided in the area sandwiched by the two pairs of the short stub line electrodes and the open stub line electrodes. Moreover, no crossover electrodes connecting the ground electrodes crossing over the respective line electrodes are provided. Therefore, when the FET parts are off, and the respective stub line electrodes perform their original functions, the potentials of the ground electrodes existing in the area sandwiched between the two pairs of the short stub line electrodes and the open stub line electrodes differ from the potential in the area excluding the above-described area sandwiched between the two pairs. In this case, the respective stub line electrodes and the main line between the stub line electrodes do not function as an ideal coplanar waveguide.

Regarding the open stub line electrodes, each open stub line electrode and the ground electrode are separated from each other, the asymmetrical state is not large. Regarding the short stub line electrodes, the end of each short stub line electrode is connected directly to the ground electrode. Thus, the asymmetrical state of the electrical field distribution is large on the one terminal-side of the short stub line electrode (on the connection point side where the short stub line electrode is connected to the mainline electrode). Specifically, e.g., in the case of the short stub line electrode 31, the electric field distribution between the line electrode and the ground electrode on the left side of the line electrode is substantially the same as the electric field distribution of a short stub line electrode as a substantially normal coplanar line electrode. On the other hand, substantially no electric field is generated on the right side of the short stub line electrode. This is true of the short stub line electrode 33. As described above, the electric field is not easily generated. This means that a capacity is not easily produced between the short stub line electrode and the ground electrode. In other words, the ground electrode does not function correctly in the area between the two short stub line electrodes. Therefore, the distributed capacity component in each of the overall short stub line electrodes decreases. The distributed inductance component in each of the overall short stub line electrode depends on the shape and size of the stub line electrode itself, and hence, suffers substantially no changes. Therefore, the characteristic impedance of the short stub line electrode is high. This increases the equivalent inductance component of the short stub line electrode. As described above, the equivalent inductance component of the short stub line electrode increases. This causes the resonance frequency of the resonance circuit including the short stub line electrode and the open stub line electrode is reduced. To prevent the resonance frequency of the resonance circuit from being reduced, the total length of the short stub line electrode and the open stub line electrode is decreased. Accordingly, in the high frequency switch 100, the total length of the short stub line electrode and the open stub line electrode is decreased, such that the total size is reduced. Also, in this case, the high frequency switch 100 functions as a switch corresponding to the same frequency.

As described, the ground electrode cannot correctly function in the area between the two short stub line electrodes. This is true when the FET parts are off. When the FET parts are on, both of the sides of each short stub line electrode are connected to the ground electrode. Thus, the ground electrode in the area sandwiched between the two short stub line electrodes functions substantially the same as an ordinary ground electrode as well as the ground electrode on the open stub line electrode side.

In the high frequency switch 100, the gate electrode is arranged so as to extend in one continuous line on the open stub line electrode and on the short stub line electrode side. The gate electrode is led out from one of the sides, although this is not shown. Alternatively, the gate electrode may be led out from both sides similar to the high frequency switch 10*a*.

Figure 20:
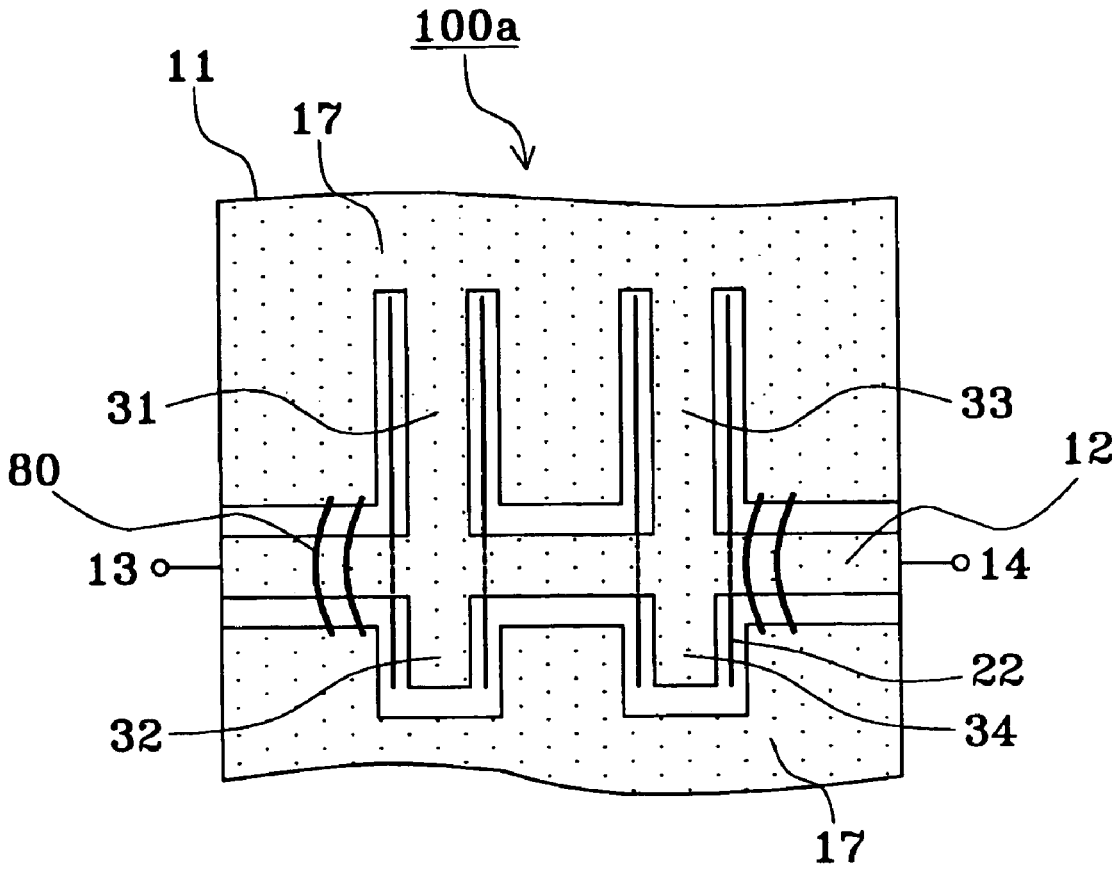
FIG. 20 is a plan view of a high frequency switch according to an even further preferred embodiment of the present invention.

FIG. 20 shows a modified example of the high frequency switch 100. In the high frequency switch 100*a* shown in FIG. 20, with respect to the eight branch points of the line electrodes, two crossover wirings 80 adjacent to each other are provided to connect the ground electrodes on the left side (in the drawing) of the pair of the short stub line electrode 31 and the open stub line electrode 32 so as to cross over the main line electrode 12. Moreover, two crossover wirings 80 adjacent to each other are provided so as to connect the ground electrodes on the right side (in the drawing) of the pair of the short stub line electrode 33 and the open stub line electrode 34 so as to cross over the main line electrode 12. In this case, the propagation of an unnecessary mode signal is suppressed more effectively as compared to the case of one crossover wiring 80. Needless to say, the same advantages are obtained by increasing the width of each crossover wiring instead of increasing the number of crossover wirings.

Figure 21:
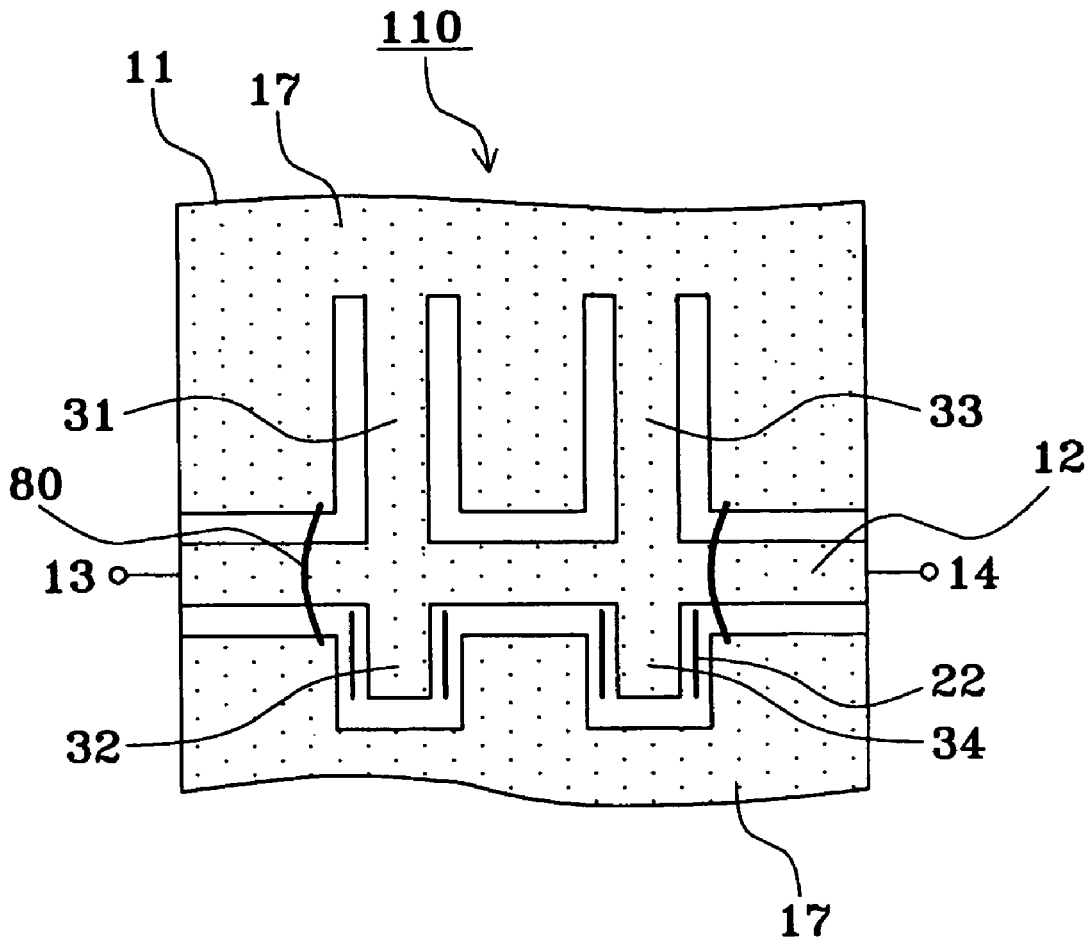
FIG. 21 is a plan view of a high frequency switch according to another preferred embodiment of the present invention.

FIG. 21 is a plan view of another modified example of the high frequency switch 100 according to the present invention. The high frequency switch 110 shown in FIG. 21 is a modification based on the configuration of the high frequency switch 100 shown in FIG. 19. The parts which are the same as or equivalent to those shown in FIG. 19 are designated by the same reference numerals. The description is omitted.

For the short stub line electrodes 31 and 33 in the high frequency switch 110, no gate electrodes are provided between the line electrodes and the ground electrode, and thus, no FET structures are provided. The high frequency switch 110 is the same as the high frequency switch 100 except for the above-described respect.

The operation of the high frequency switch 110 configured as described above is substantially the same as that of the high frequency switch 100 which is carried out when the FET parts are off, and as a whole, the switch is on. Moreover, the side edge portions of the short stub line electrodes 31 and 33 have no FET structures. Thus, the losses of the lines are decreased. As a result, the insertion loss occurring when the high frequency switch 110 is on is further reduced as compared to the high frequency switch 100.

Figure 22:
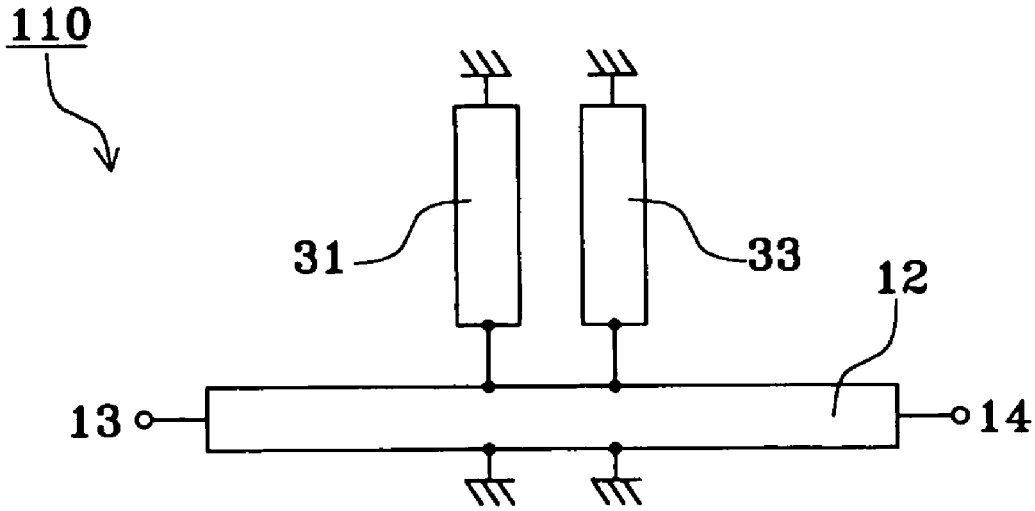
FIG. 22 is an equivalent circuit diagram of the high frequency switch of FIG. 21, obtained when the switch is off.

On the other hand, when the FET parts are on, a portion of the main line electrode 12 is grounded only on the sides of the open stub line electrodes 32 and 34. Regarding the short stub line electrode 31 and 33 sides, the short stub line electrodes remain in the connected state. This state is equivalently shown in FIG. 22. In this case, a portion of the main line electrode 12 is also grounded. Thus, as a whole, the switch is turned off. However, the grounding state is deteriorated as compared to that of a high frequency switch in which both of the short stub line electrodes 31 and 33 are connected to the side edges of the main line electrode 12. Thus, the isolation caused when the switch is off is undesirable as compared to that of the high frequency switch 100.

Figure 23:
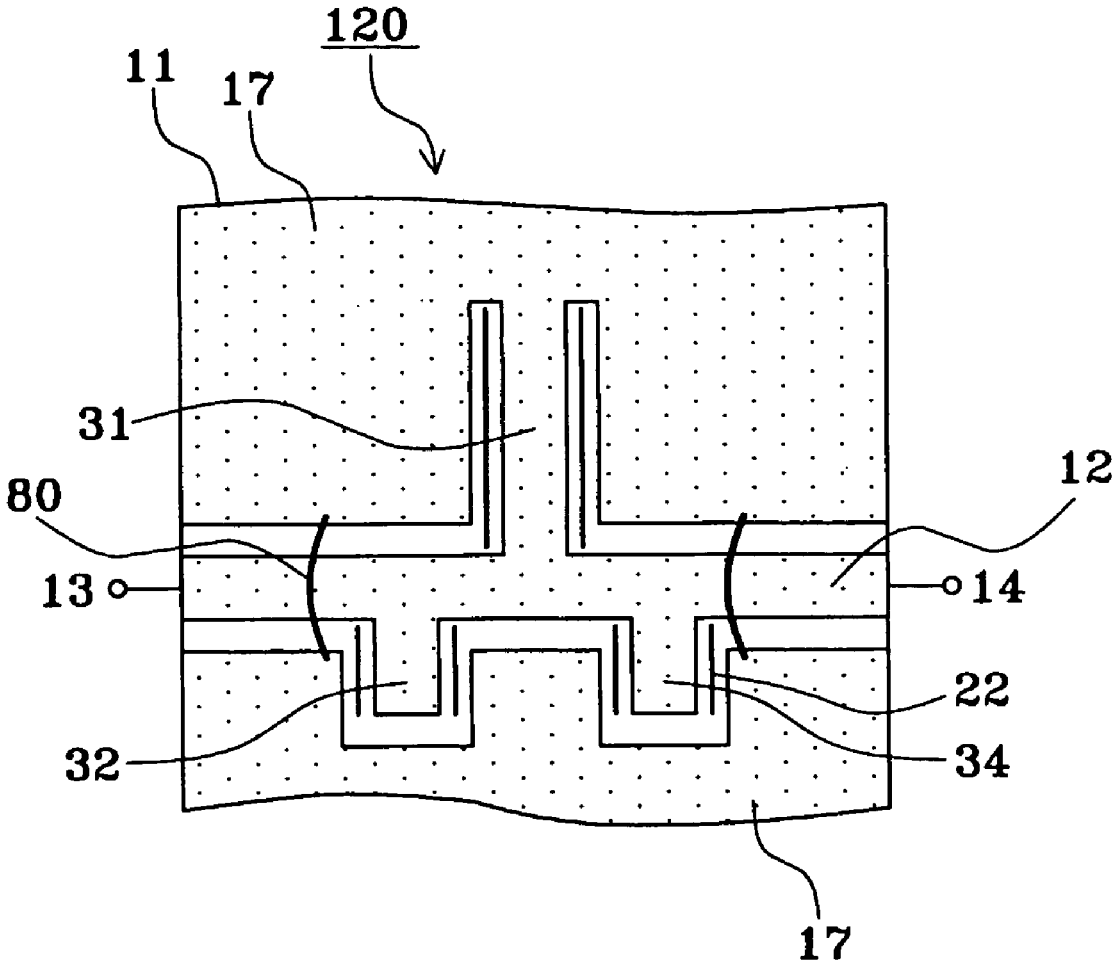
FIG. 23 is a plan view of a high frequency switch according to yet another preferred embodiment of the present invention.

FIG. 23 is a plan view of another modification of the high frequency switch 100 according to the present invention. The high frequency switch 120 shown in FIG. 23 is modified based on the configuration of the high frequency switch 100 shown in FIG. 19. The parts which are the same as or equivalent to those shown in FIG. 19 are designated by the same reference numerals. The description is omitted.

The high frequency switch 120 is the same as the high frequency switch 100 except that one of the two short stub line electrodes of the high frequency switch 100 is eliminated, and the remaining one is shifted to an intermediate position between the two original short stub line electrodes. The high frequency switch 120 is not different from the high frequency switch 100 except in this respect.

As described above, the area sandwiched between the two short stub line electrodes in the high frequency switch 100 cannot perform its original function as a ground electrode. Thus, it is unnecessary to provide two short stub line electrodes in the high frequency switch 100. Derived from this, it is supposed that the two short stub line electrodes may be integrated into one short stub line electrode having a large width, which provides the same results as the high frequency switch 100. Furthermore, in the high frequency switch 120, the width of the integrated short stub line electrodes is restored to the original width.

Hereinafter, the operation of the high frequency switch 120 will be described. The basic operation caused when the FET parts of the respective stubs are on is the same as that of the high frequency switch 100 shown in FIG. 19. However, the number of stubs is three, and thus, the number of the connecting points of the main line electrode 12 is three. The isolation caused when the high frequency switch is off is slightly deteriorated as compared to that of the high frequency switch 100.

On the other hand, when the FET parts of the respective stubs are off, the two open stub line electrodes are connected to one side-edge of the main line 18, while the one short stub line electrode is connected to the other side edge of the main line 18. In this case, regarding the resonance circuit provided of the stubs, the capacity component caused by the open stub line electrodes is two times based on the inductance component caused by the short stub line electrode. Thus, the resonance frequency is reduced. This means that the line length of the short stub line electrode can be reduced where the resonance frequency is not decreased. As a result, the size of the high frequency switch can be further reduced. Moreover, the loss in the lines decreases corresponding to the reduced number of the short stub line electrodes. As a result, the insertion loss occurring when the high frequency switch 120 is on is more reduced as compared to that of the high frequency switch 100.

Figure 24:
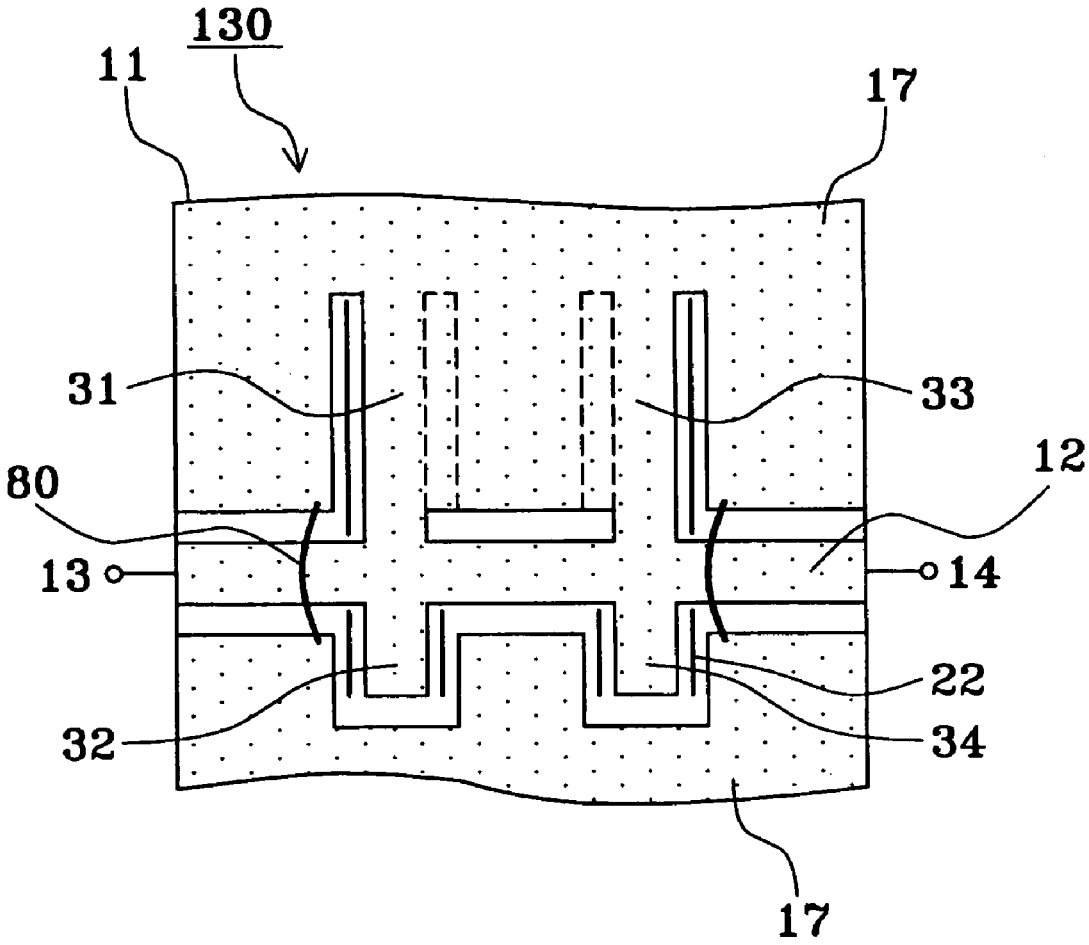
FIG. 24 is a plan view of a high frequency switch according to another preferred embodiment of the present invention.

FIG. 24 is a plan view of still another modified example of the high frequency switch 100 according to the present invention. A high frequency switch 130 shown in FIG. 24 is configured based on the configuration of the high frequency switch 100 shown in FIG. 19. The parts which are the same as or equivalent to those of the high frequency switch 100 shown in FIG. 19 are designated by the same reference numerals. The description is omitted.

The high frequency switch 130 is the same as the high frequency switch 100 except that the gaps between the short stub line electrodes and the ground electrode 17 existing on the opposed sides of the two short stub line electrodes of the high frequency switch 100 are eliminated, such that the short stub line electrodes are arranged to be continuous with the ground electrode 17, and simultaneously, the gate electrodes present in the gaps are removed. Thus, the high frequency switch 130 is the same as the high frequency switch 100 except in the above-described respect.

As described above, the area sandwiched between the two short stub line electrodes in the high frequency switch 100 does not sufficiently perform the original function as a ground electrode. Accordingly, this means that there is no reason for the existence of the gaps between the line electrodes and the ground electrode on the opposed sides of the two short stub line electrodes. The high frequency switch 130 is a preferred embodiment of the above-described idea.

Hereinafter, the operation of the high frequency switch 130 will be described. First, the basic operation caused when the FET parts in the respective stub line electrodes are on is the same as that of the high frequency switch 100 shown in FIG. 19.

On the other hand, when the FET parts in the respective stub line electrodes are on, the operation of the high frequency switch 130 is not substantially different from that of the high frequency switch 100, since the parts where substantially no electric field is produced are connected to each other so as to be continuous. The loss in the areas of the short stub line electrodes corresponding to the reduced FET structures decrease. As a result, the insertion loss occurring when the high frequency switch 130 is on is reduced as compared to that of the high frequency switch 100.

Figure 25:
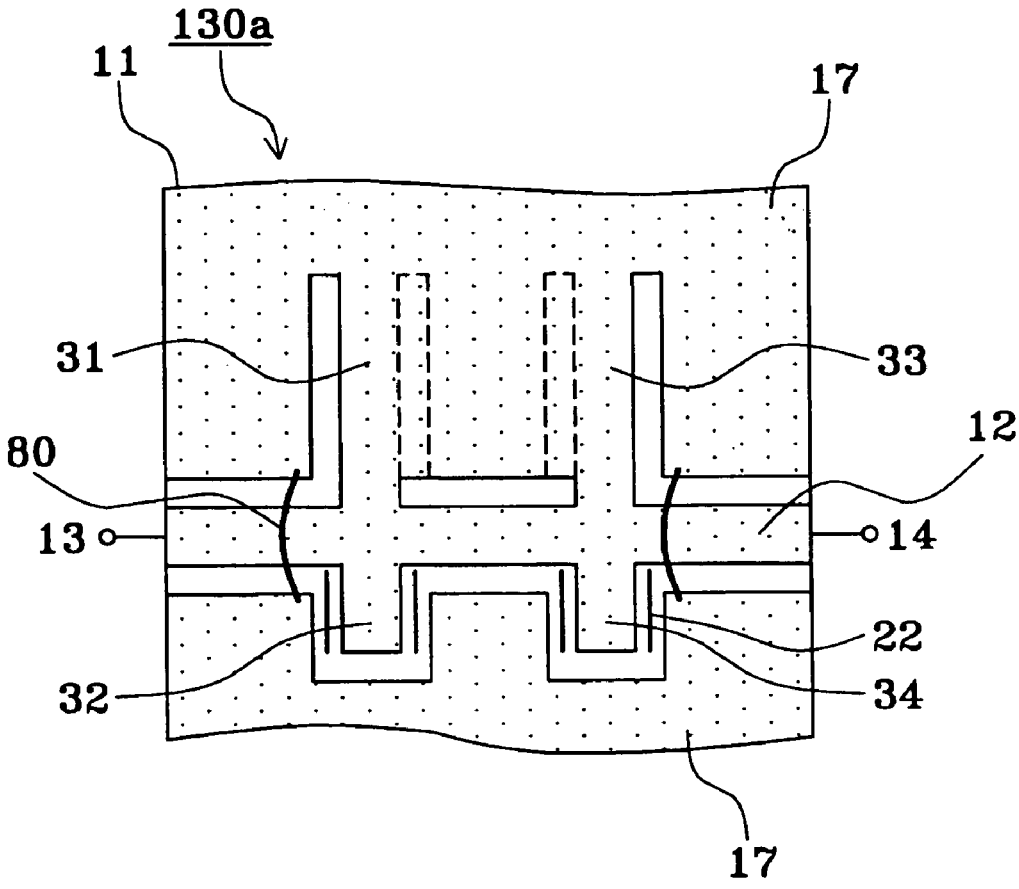
FIG. 25 is a plan view of a high frequency switch according to still another preferred embodiment of the present invention.

In the high frequency switch 130, the gate electrodes remain on the other sides of the short stub line electrodes 31 and 33, respectively. The gate electrodes remaining on the other sides of the short stub line electrodes 31 and 33 may be removed as seen in a high frequency switch 130*a* which is shown in FIG. 25 as a modified example, for the same reason with respect to the high frequency switch 110 shown in FIG. 21. In this case, the loss in the area of the short stub line electrodes corresponding to the further reduced FET parts is decreased. As a result, the insertion loss occurring when the high frequency switch 130*a* is on is reduced as compared to the high frequency switch 130. However, the isolation caused when the switch is off is deteriorated compared to that of the high frequency switch 130 as in the case of the high frequency switch 110.

Figure 26:
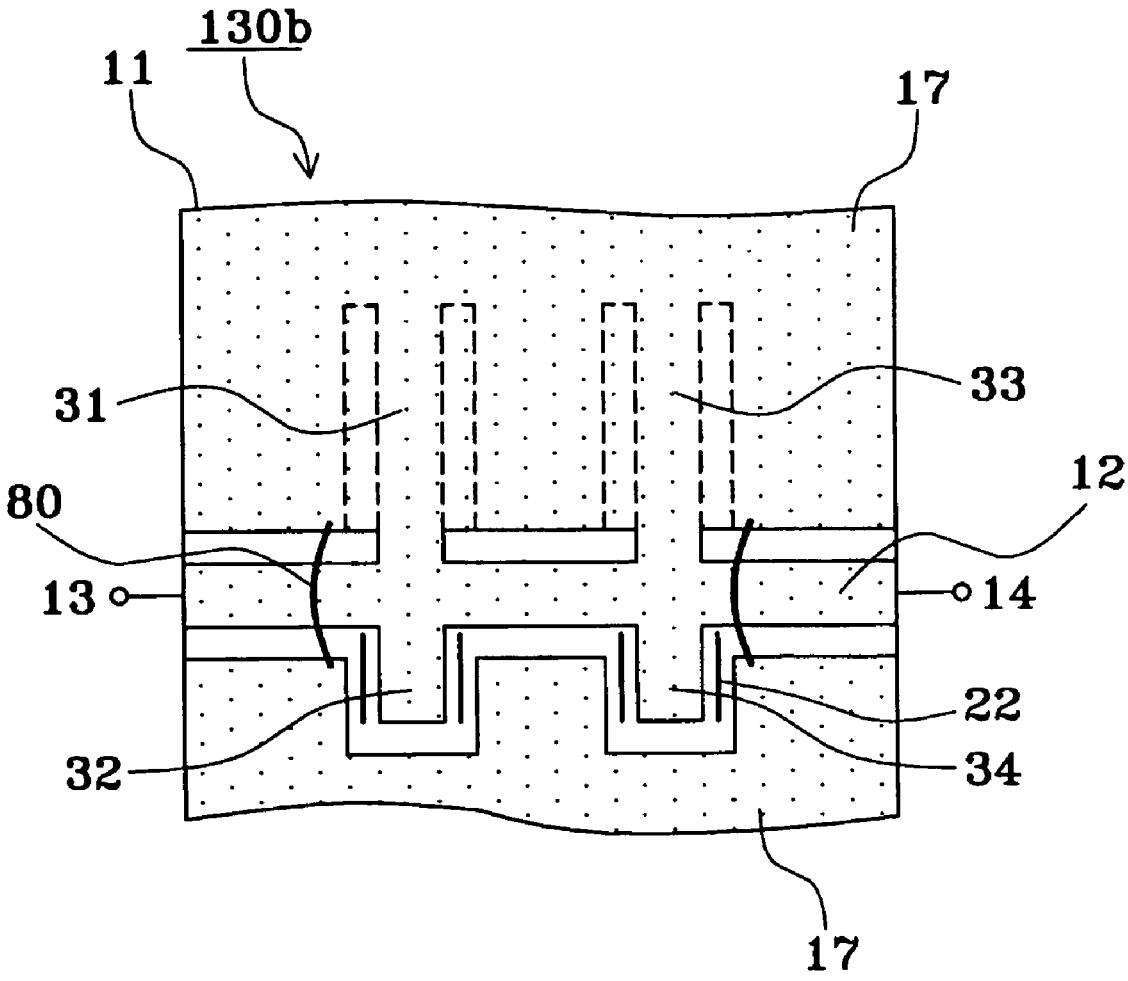
FIG. 26 is a plan view of a high frequency switch according to yet another preferred embodiment of the present invention.

As described above, the high frequency switch 130*a* is configured by modifying the high frequency switch 130. Further, the configuration of a high frequency switch 130*b* is shown in FIG. 26. This configuration is achieved by further modifying the high frequency switch 130*a*. In particular, in the high frequency switch 130*a*, the gaps where the gate electrodes are removed are eliminated, such that the short stub line electrodes are continuous with the ground electrode 17. In this case, the parts of the main line electrode 12 to which the short stub line electrodes are originally connected are always connected to the ground electrode. Thus, the insertion loss occurring when the switch is on is deteriorated, and the bandwidth is reduced. On the other hand, when the switch is off, the route from the main line electrode 12 to the ground electrode 7 is reduced. Thus, the isolation characteristic is further improved.

In any of the high frequency switches 130, 130*a*, and 130*b*, no crossover wirings are provided in the root portions of the open stub line electrodes 32 and 34, which connect the ground electrodes existing on both of the sides of the respective line electrodes. Regarding the open stub line electrode side, the asymmetrical state of electric field distribution is not increased in the area between the open stub line electrodes, even if the crossover wirings crossing over the main line electrode 12 are not provided. Therefore, the crossover wirings may be provided in the root portions of the open stub line electrodes 32 and 34, which connect the ground electrodes existing on both of the sides of the respective line electrodes. For stable operation of the open stub line electrodes, it is preferable to provide the crossover wirings.

Figure 27:
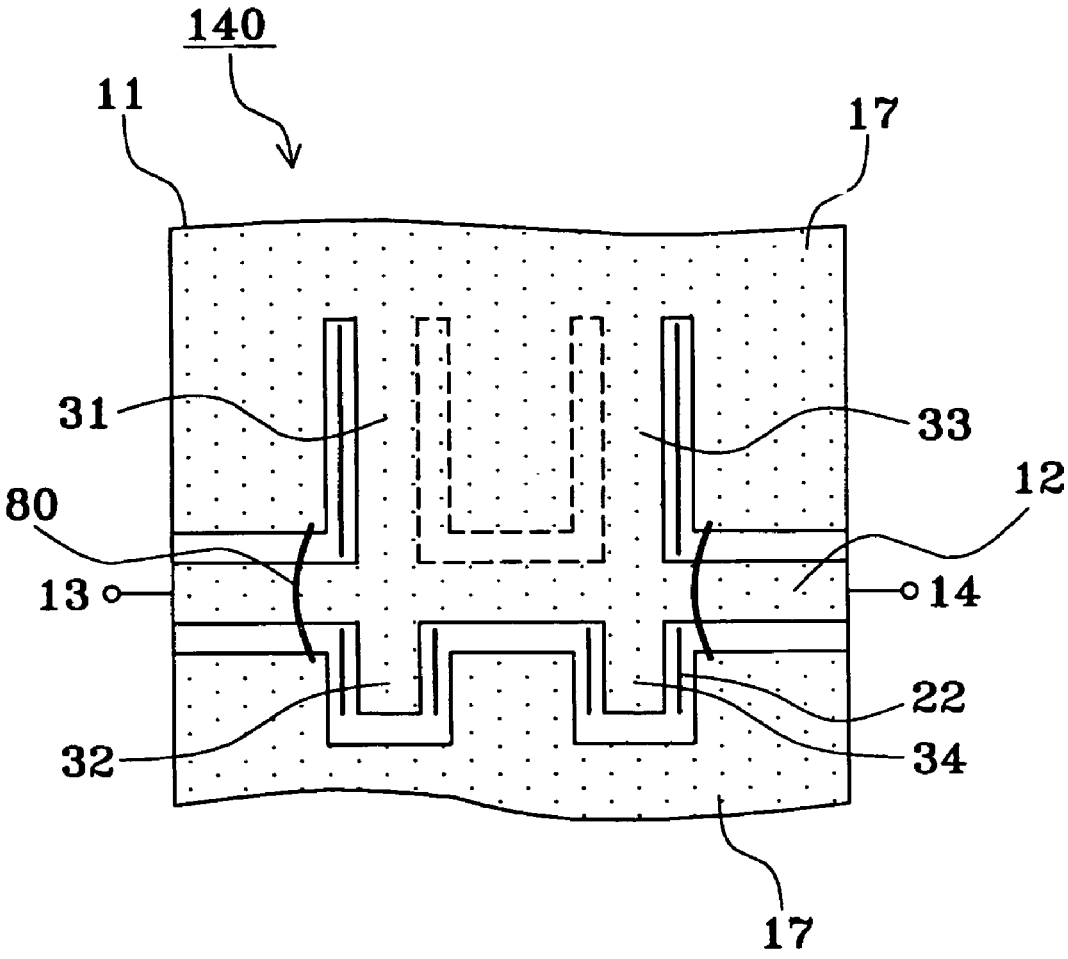
FIG. 27 is a plan view of a high frequency switch according to a further preferred embodiment of the present invention.

FIG. 27 is a plan view of yet another modification of the high frequency switch 100 according to the present invention. A high frequency switch 140 shown in FIG. 27 is modified based on the configuration of the high frequency switch 130 shown in FIG. 24. The parts which are the same as or equivalent to those of the high frequency switch 130 shown in FIG. 24 are designated by the same reference numerals. The description is omitted.

In the high frequency switch 140, the gap between the main line electrode 12 and the ground electrode 17 in the area between the two short stub line electrodes, which is provided in the high frequency switch 130, is eliminated. Accordingly, the side edge on one side of the main line electrode 12 in the above-described area is continuous with the ground electrode.

As described above, regarding the line electrodes surrounding the area between the two short stub line electrodes, no crossover wirings connecting the ground electrodes on both of the sides of the respective line electrodes so as to cross over the line electrodes are provided, and thereby, the ground electrode in the area between the two short stub line electrodes cannot properly function as a ground electrode. This means that there is no significant reason for not only the short stub line electrodes but also the main electrode in this area. Thus, no substantial problems occur with respect to the function, even if the gaps to the ground electrode are eliminated. This is embodied in the high frequency switch 140.

Hereinafter, the operation of the high frequency switch 140 will be described. First, the basic operation caused when the FET parts in the respective stub line electrodes are on is the same as that of the high frequency switch 130 shown in FIG. 24. However, in the case of the high frequency switch 140, the main line electrode 12 is originally connected to the ground electrode 17 in the area between the two short stub line electrodes. Therefore, a part of the main line electrode 12 is grounded with improved stability as compared to the high frequency switch 130. Therefore, the isolation caused when the switch is off is further improved.

On the other hand, when the FET parts in the respective stub line electrodes are off, the operation of the high frequency switch 140 is substantially the same as that of the high frequency switch 130, since a part of the main line electrode 12 is connected to the ground, and in the part, substantially no electric field is generated.

Figure 28:
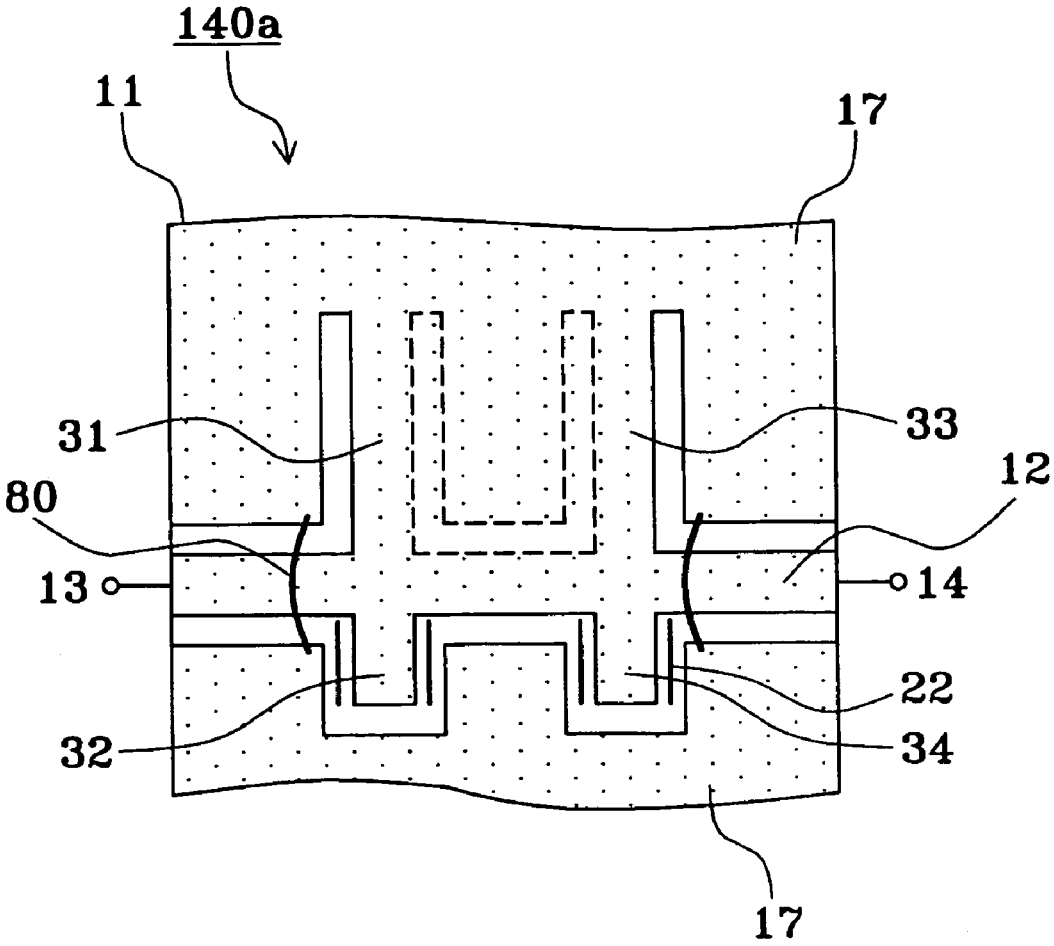
FIG. 28 is a plan view of a high frequency switch according to an even further preferred embodiment of the present invention.
Figure 29:
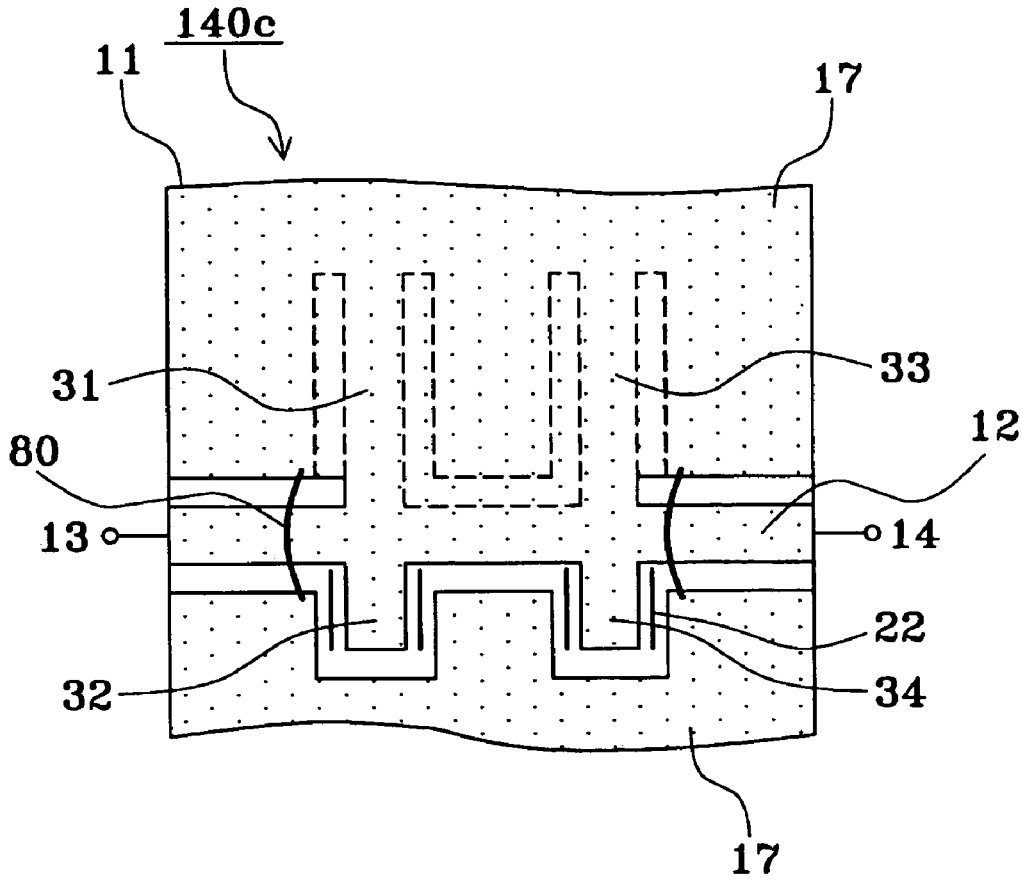
FIG. 29 is a plan view of a high frequency switch according to another preferred embodiment of the present invention.

Also, regarding the high frequency switch 140, variations may be available similar to the high frequency switch 130. In particular, the FET structures on the short stub line electrode side may be eliminated as in the case of the high frequency switch 140*a* shown in FIG. 28. Moreover, the gaps in the area of the high frequency switch 140*a* from which the gate electrodes are removed, the gaps being provided in the high frequency switch 140*a*, may be eliminated as in the case of the high frequency switch 140*b* shown in FIG. 29. The above-described high frequency switches

140*a* and 140*b* have the same operation and effects as the high frequency switches 130*a* and 130*b*.

Figure 30:
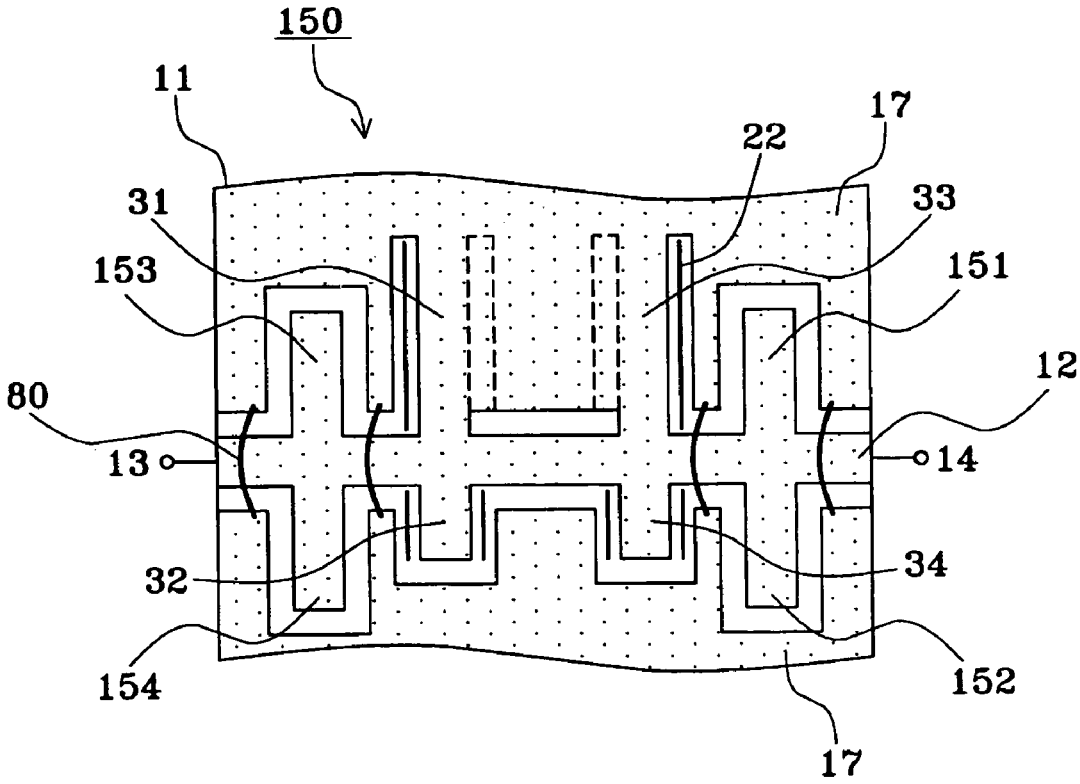
FIG. 30 is a plan view of a high frequency switch according to still another preferred embodiment of the present invention.

FIG. 30 is a plan view of a high frequency switch according to another preferred embodiment of the present invention. In FIG. 30, the parts which are the same as or equivalent to those of the high frequency switch 30 shown in FIG. 24 are designated by the same reference numerals. The description is omitted.

A high frequency switch 150 shown in FIG. 30 is substantially the same as the high frequency switch 130 shown in FIG. 24 except that one-side ends of a pair of open stub line electrodes 151 and 152 and those of a pair of open stub line electrodes 153 and 154 are connected to the side edges opposed to each other of the main line electrode 12 on both of the sides in the main line electrode extending direction, respectively. The respective open stub line electrodes are coplanar waveguides. Crossover wirings 80 are provided on both of the sides of the pairs, which connect the ground electrodes so as to cross over the main line electrode 12. The length of each open stub line electrode is set to be less than one-fourth of the wavelength at a signal frequency. The lengths of the open stub line electrodes are equal to each other. The both sides of the respective open stub line electrodes have no FET structures. Thus, no gate electrodes are provided.

In the high frequency switch 150 configured as described above, the respective open stub line electrodes function as capacitor components provided between the respective positions of the main line electrode 12 and the ground electrode. Therefore, a pole provided which has desired frequency components, and the bandwidth can be increased by appropriately setting the capacitor components. In addition, since the lengths of the open stub line electrodes are equal to each other, and the line structures are the same, the propagation of a signal in an unnecessary mode is effectively suppressed.

Figure 31:
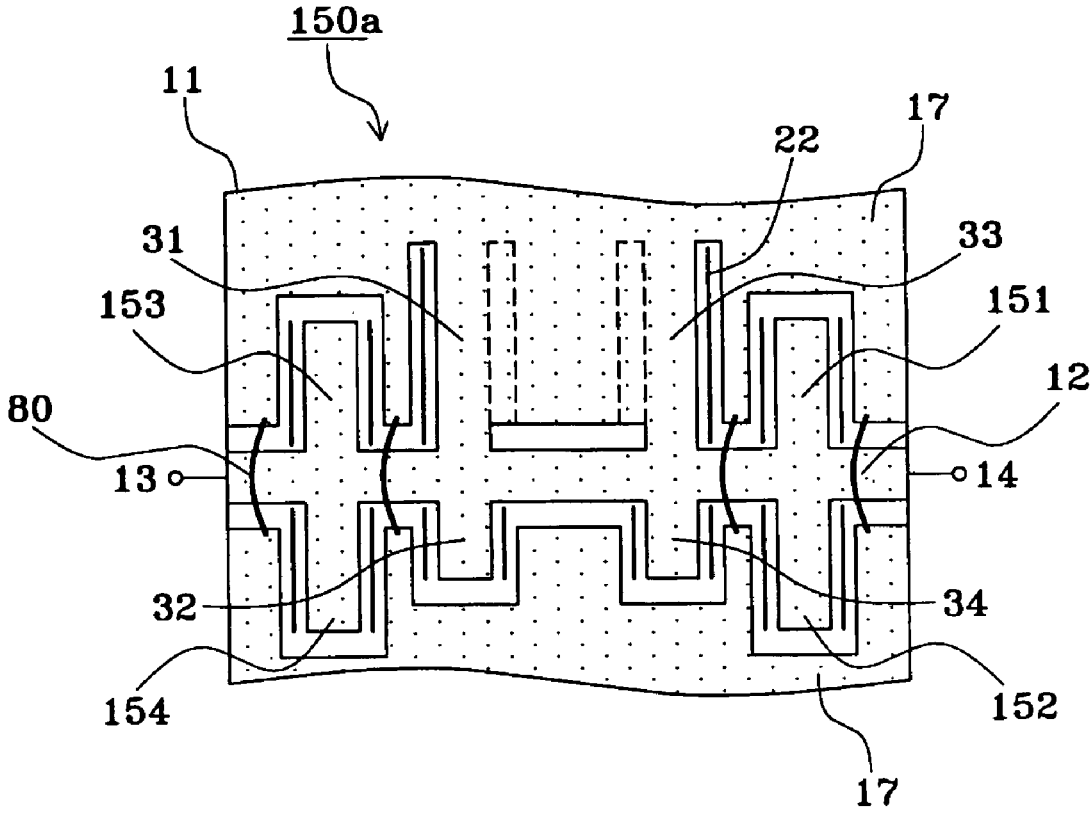
FIG. 31 is a plan view of a high frequency switch according to yet another preferred embodiment of the present invention.

FIG. 31 shows a modification example of the high frequency switch 150. In a high frequency switch 150*a* shown in FIG. 31, both of the sides of the four open stub line electrodes 151, 152, 153, and 154 are provided with gate electrodes and semiconductor activation layers, and hence, have FET structures. When the FET structures are off, and the open stub line electrodes function as capacitor components, the operation of the high frequency switch 150*a* is the same as that of the high frequency switch 150. On the other hand, when the FET structures are on (the high frequency switch is off), the number of the positions in which the main line electrode 12 is connected to the ground electrode 17 increases. Therefore, the isolation can be further enhanced.

Figure 32:
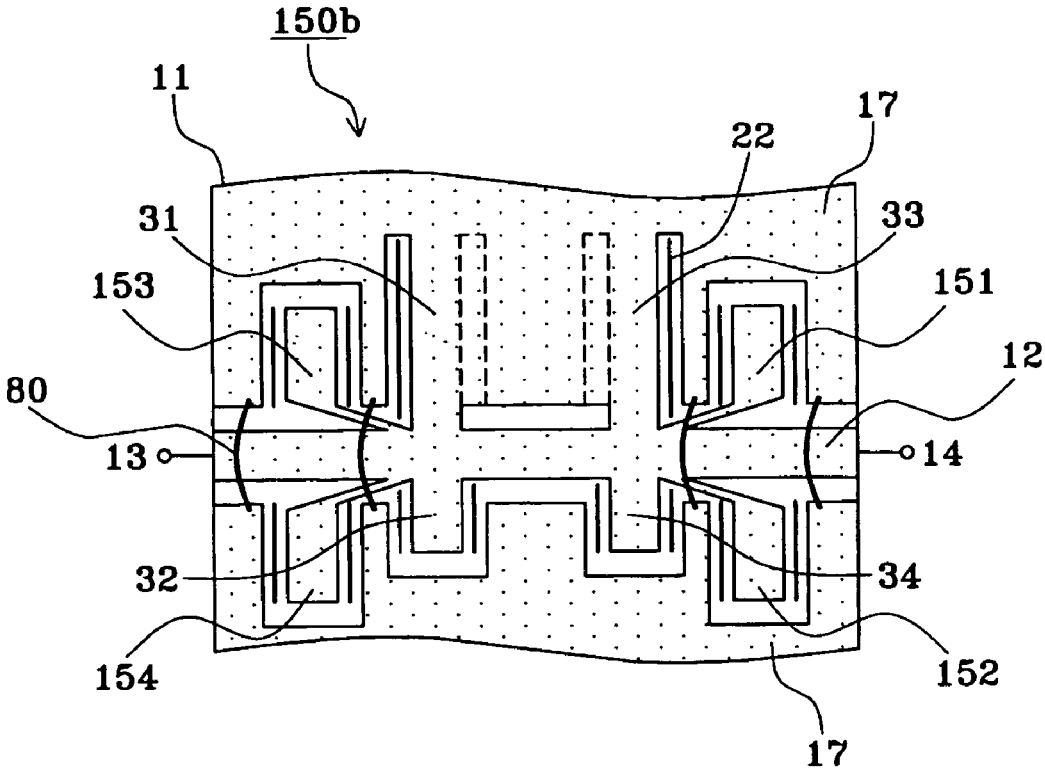
FIG. 32 is a plan view of a high frequency switch according to a further preferred embodiment of the present invention.

Then, FIG. 32 shows another modified example of the high frequency switch 150. A high frequency switch 150*b* shown in FIG. 32 is configured based on the configuration of the high frequency switch 150*a*. In the high frequency switch 150*b*, the connecting points at which the four open stub line electrodes are connected to the main line electrode are set near the connecting points of the stub line electrodes provided on the inner sides of the four open stub line electrodes.

According to the above-described configuration, the bandwidth is increased, and the isolation is enhanced as in the case of the high frequency switch 150*a*. In addition, the area where the respective stub line electrodes are connected to the main line electrode 12 is reduced. Therefore, the reflection characteristic exhibited when the switch is off is increased.

In the respective high frequency switches 150, 150*a*, and 150*b*, the lengths of the four open stub line electrodes 151, 152, 153, and 154 are equal to each other. However, this is not required. The lengths of the open stub line electrodes may be optionally set, provided that the stub line electrodes function as a capacitor component.

Moreover, in the high frequency switches 150, 150*a*, and 150*b*, the four open stub line electrodes are added to the configuration of the high frequency switch 130 used as a basic configuration. Moreover, other configurations such as those of the high frequency switches 100, 100*a*, 110, 120, 130*a*, 140, 140*a*, and 140*b* may be used as a basic configuration to be modified. Also, in this case, the same operation and effects are obtained.

In the above-described preferred embodiments, examples of so-called SPT switches (Single Pole Single Through, one to one) in which conduction is caused between two terminals, or the conduction is cut off) are described. So-called SP×T (Single Pole×Through, one to multiple) switches may be provided by a plurality of the high frequency switches according to the present invention.

Figure 33:
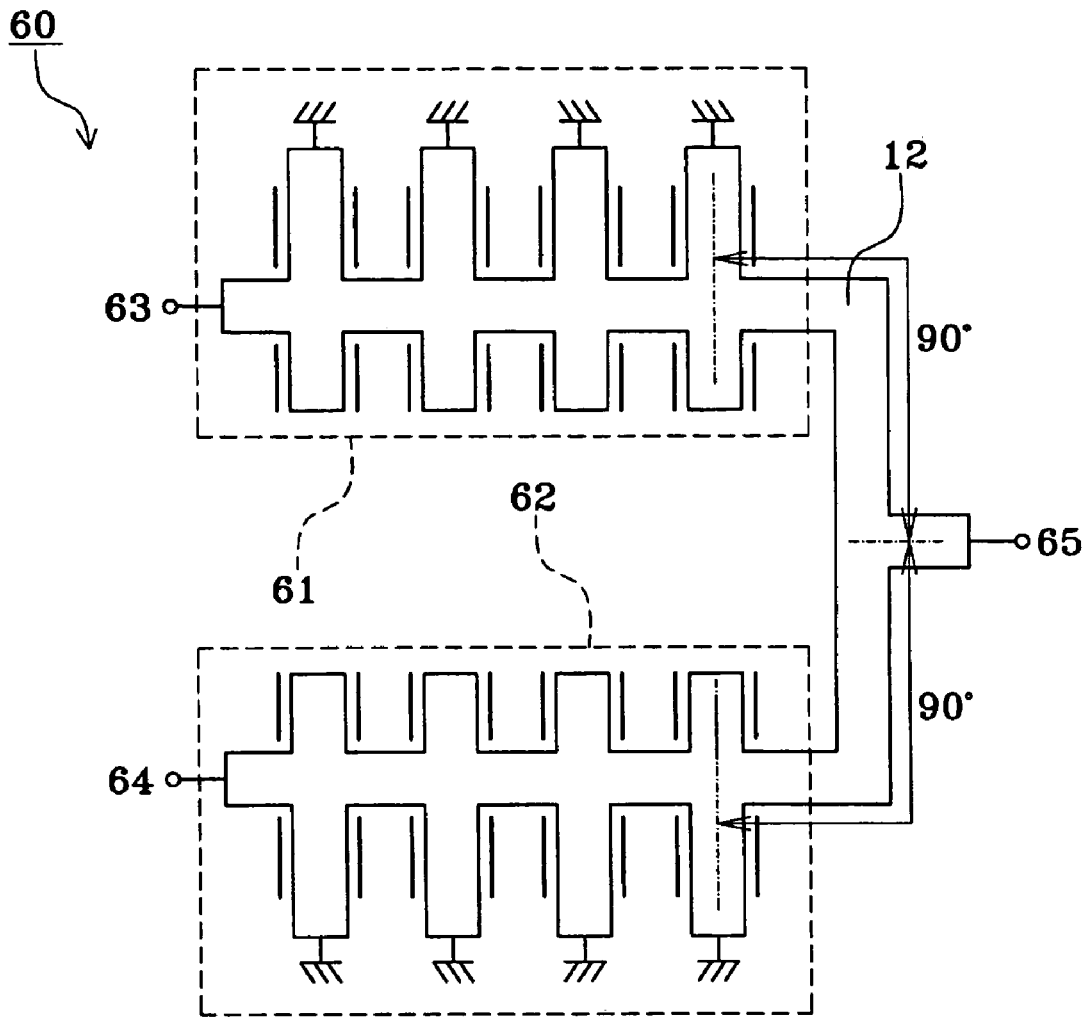
FIG. 33 is a plan view of a high frequency switch according to an even further preferred embodiment of the present invention.

FIG. 33 is a schematic view of a high frequency switch according to still another preferred embodiment of the present invention. In FIG. 33, the high frequency switch is schematically shown to clarify the features thereof. The parts which are the same as or equivalent to those of the high frequency switch 10 shown in FIG. 1 are designated by the same reference numerals. The description is omitted.

In a high frequency switch 60 shown in FIG. 33, one ends of high frequency switches 61 and 62 each of which is similar to the high frequency switch 50 shown in FIG. 18 are connected to each other, and is used as a third terminal. As shown in FIG. 33, one end of one high frequency switch 61 is connected to a terminal 63, and one end of the other high frequency switch 62 is connected to a terminal 64. The other ends of the two high frequency switches 61 and 62 are connected to each other, and moreover, are connected to a terminal 65. The length of the main line electrode 12 extending from the connecting point to the nearest stub line electrode in each of the high frequency switches 61 and 62 is set to have an electrical length of about 90° with respect to a high frequency signal.

The respective high frequency switches 61 and 62 of the high frequency switch 60 configured as described above operate as a switch with a low loss. Moreover, as described above, the length of the main line electrode 12 extending from the connecting point to the nearest stub line electrode in each of the high frequency switches 61 and 62 is set to have an electrical length of about 90° with respect to a high frequency signal. Therefore, when one high frequency switch 61 is on, and the other high frequency switch 62 is off, it appears that, as seen from the connecting point of the two high frequency switches, the high frequency switch 62 in the off-state has an infinite impedance. That is, this is equivalent to the case where the high frequency switch 62 in the off-state does not exist. Therefore, an SPDT (Single Pole Dual Through, one to two) switch in which the mismatching is suppressed, and the insertion loss of the switch in the on-state is reduced is obtained.

In the above-described preferred embodiment, the length of the main line electrode 12 extending from the connecting point, at which the other terminals of the high frequency switches 61 and 62 are connected to each other, to the nearest stub line electrode in each of the high frequency switches 61 and 62 is set to have an electrical length of about 90° with respect to a high frequency signal. This setting is for the ideal case in which the resistance for the ground is sufficiently small. Practically, the above-described length of the main line electrode 12 is slightly smaller on an electrical length basis. For example, in some cases, the electrical length may be about 80°.

In the high frequency switch 60, the SPDT switch is realized. Moreover, a SP×T switch can be defined by at least three high frequency switches 50 in such a manner as described above.

Moreover, the two SPST type high frequency switches used here are not restricted to the high frequency switches 50. Any of the above-described high frequency switches may be used.

The above-described preferred embodiments have the same configuration as that of the high frequency switch 10 shown in FIG. 1 as a basic one. Referring to the high frequency switch 10, when the switch is off (i.e., the FET parts are on), the DC potential of the gate becomes 0 V, which is equal to that of the drain and the source, such that the gate is not biased with respect to the drain and the source. However, the depletion layer also exists in the state in which the gate is not biased.

Thus, it is proposed that the depletion layer is further decreased by forward biasing the gate with respect to the drain and the source. In this case, when the FET parts are on, the resistance between the respective stub line electrodes and the ground electrode is further decreased. Thus, the cutoff characteristic exhibited when the switch is off is enhanced.

Moreover, the cutoff characteristic per one pair of stubs exhibited when the switch is off is enhanced. Thus, the characteristic of a switch containing plural pairs of stubs is enhanced. Accordingly, for example, the isolation characteristic of the high frequency switch 50 shown in FIG. 18 is maintained with a reduced number of pairs of stubs by forward-biasing the gates when the FET parts are on. As described above, the number of stubs is reduced. This means that the area of the high frequency switch is decreased corresponding to the reduced number of stubs. Furthermore, this means that the insertion loss occurring when the switch is on is reduced corresponding to the reduced number of stubs. This effect is obtained with SP×T switches involving SPDT switches such as the high frequency switch 60 shown in FIG. 33 in addition to SPST switches such as the high frequency switches 10 and 50.

In the combination of an open stub line electrode and a short stub line electrode in the respective high frequency switches of the above-described preferred embodiments, the length of the short stub line electrode is set to be greater than that of the open stub line electrode. This is done for illustration only, having no special meanings. Needless to say, the length of the open stub line electrode may be greater than that of the short stub line electrode. Both of the lengths may be set to be equal to each other.

Figure 34:
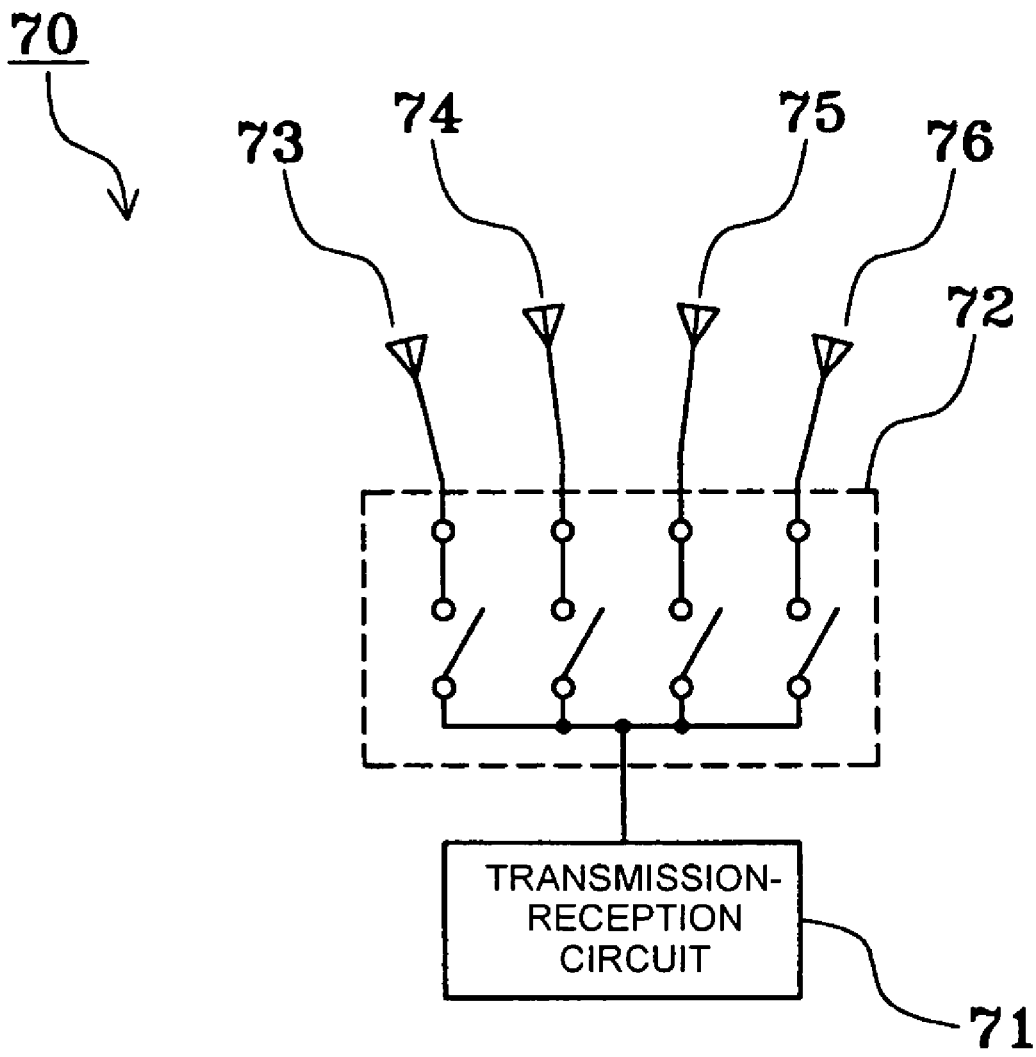
FIG. 34 is a block diagram of an electronic device according to a preferred embodiment of the present invention.

Then, FIG. 34 is a block diagram of an electronic device according to a preferred embodiment of the present invention. In FIG. 34, an electronic device 70 is a radar device, and includes a transmission-reception circuit 71, a high frequency switch 72, and four antennas 73, 74, 75, and 76. Of these elements, the high frequency switch 72 is a one-input four-output high frequency switch which includes four high frequency switches according to the present invention which are operated by the SPST system as described above. The respective switches are turned on sequentially one by one. The transmission-reception circuit 71 is connected to one of the antennas via the contained switch in the on-state. Thus, a signal is transmitted or received. The four antennas 73, 74, 75, and 76 have different directivities. Thus, the switches of the high frequency switch 72 are changed over, and thereby, the device functions as radar which operates in the four directions.

The insertion loss, occurring when the switch is on, of the high electronic device 70 configured as described above is small, since the device 70 includes the high frequency switch 72 according to the present invention. Thus, the loss of a signal is reduced, and the consumption power is decreased. Moreover, the cutoff characteristic exhibited when the switch is off is superior. Accordingly, error operation such as irradiating a radar wave in an unintentional direction, sensing an object existing in an unintentional direction, and so forth are suppressed.

In FIG. 34, the radar device is shown as the electronic device of the present invention. The type of the electronic device is optional, provided that the device includes the high frequency switch of the present invention.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A high frequency switch comprising:

a main line electrode provided on a substrate so as to extend between two terminals;

a short stub line electrode provided on the substrate and having one end connected to a one-side edge of the main line electrode, and another end that is grounded;

an open stub line electrode provided on the substrate having one end connected to an other-side edge of the main line which is in opposed to the one-side edge, and another end that is opened;

ground electrodes provided on the substrate adjacent to the short stub line electrode and the open stub line electrode in a width direction thereof;

a semiconductor activation layer provided in the portion of the substrate between a side edge at least on the one-end side of the open stub line electrode and the ground electrode so as to be extended under the open stub line electrode and under the ground electrode; and a gate electrode provided on the semiconductor activation layer between the open stub line electrode and the ground electrode so as to extend along a longitudinal direction of the open stub line electrode, whereby an FET structure is provided.

2. A high frequency switch according to claim 1, wherein the semiconductor activation layer is provided in the portion of the substrate between the side edges of the open stub line electrode ranging from the one-side end thereof to the other-side end thereof and the ground electrode so as to extend under the open stub line electrode and under the ground electrode, and the gate electrode is provided on the semiconductor activation layer between the open stub line electrode and the ground electrode so as to extend along the longitudinal direction of the open stub line electrode, whereby an FET structure is provided.

3. A high frequency switch according to claim 1, wherein the semiconductor activation layer is provided in the portion of the substrate between the side edges at least on the one-end side of the short stub line electrode and the ground electrode so as to be extended under the short stub line electrode and under the ground electrode, and the gate electrode is provided on the semiconductor activation layer between the short stub line electrode and the ground electrode so as to extend along the longitudinal direction of the short stub line electrode, whereby an FET structure is provided.

4. A high frequency switch according to claim 1, wherein the semiconductor activation layer is provided in the portion of the substrate between the side edges of the short stub line electrode ranging from the one-end side to the other-end side thereof and the ground electrode so as to extend under the short stub line electrode and under the ground electrode, and the gate electrode is provided on the semiconductor activation layer between the short stub line electrode and the ground electrode so as to extend along the longitudinal direction of the short stub line electrode, whereby an FET structure is provided.

5. A high frequency switch according to claim 3, wherein the gate electrode is arranged so as to continuously extend from the short stub line electrode side to the open stub line electrode side crossing over the main line electrode.

6. A high frequency switch according to claim 1, wherein the short stub line electrode and the open stub line electrode, together with the ground electrode, define a coplanar waveguide.

7. A high frequency switch according to claim 1, wherein a length from the other end of the short stub line electrode to the other end of the open stub line electrode is set to have an electrical length of about 90° with respect to a high frequency signal flowing through the high frequency switch.

8. A high frequency switch according to claim 1, wherein plural pairs each comprising the short stub line electrode and the open stub line electrode are provided at predetermined intervals in the longitudinal direction of the main line electrode.

9. A high frequency switch according to claim 8, wherein the plural pairs of the short stub line electrodes and the open stub line electrodes are provided at intervals of an electrical length of 90° with respect to a high frequency signal flowing through the high frequency switch, in the longitudinal direction of the main line electrode.

10. A high frequency switch according to claim 1, wherein two pairs each comprising the short stub line electrode and the open stub line electrode are provided at a predetermined interval in the longitudinal direction of the main line electrode, and in the two short stub line electrodes and the main line electrode between the two short stub line electrodes, crossover wirings connecting the ground electrodes existing on both of the sides of the respective line electrodes so as to cross over the line electrodes are not provided.

11. A high frequency switch according to claim 10, wherein in the two short stub line electrodes, the side-edges of the respective short stub line electrodes on one sides thereof are continuous with the ground electrode.

12. A high frequency switch according to claim 11, wherein in the two short stub line electrodes, the side-edges of the respective short stub line electrodes on the other sides thereof are continuous with the ground electrode.

13. A high frequency switch according to claim 10, wherein the ground electrode in the area between the two short stub line electrodes is continuous with the main line electrode.

14. A high frequency switch according to claim 10, wherein a pair of two open stub line electrodes are provided on both sides of the two pairs of the short stub line electrodes and the open stub line electrodes in the longitudinal direction of the main line electrode, respectively, one-side ends of the paired open stub line electrodes being connected to the side edges opposed to each other of the main line electrode, and the other-side ends thereof being opened.

15. A high frequency switch according to claim 14, wherein a semiconductor activation layer is provided in the portion of the substrate between the side edges at least on the one-side end sides of the paired open stub line electrodes and the ground electrodes so as to be extended under the open stub line electrodes and under the ground electrodes, and a gate electrode is provided on the semiconductor activation layer between the open stub line electrodes and the ground electrodes so as to extend along the longitudinal direction of the open stub line electrodes, whereby an FET structure is provided.

16. A high frequency switch according to claim 14, wherein the one-side ends of the paired open stub line electrodes are connected to the mainline electrode near the connecting points at which the pair of the short stub line electrode and the open stub line electrode adjacent to the paired open stub line electrodes are connected to the main line electrode.

17. A high frequency switch comprising plural high frequency switches according to claim 1, one-side ends of the plural high frequency switches being connected to each other via the main line electrode which ranges from the connecting point to the short stub line electrode nearest to the connecting point and from the connecting point to the open stub line electrode nearest to the connecting point and has an electrical length of about 90° with respect to a high frequency signal flowing through the main line.

18. An electronic device including the high frequency switch according to claim 1.

* * * * *